US005422224A

United States Patent [19]

Katoh

[11] Patent Number: 5,422,224

[45] Date of Patent: Jun. 6, 1995

[54] SILVER HALIDE PHOTOGRAPHIC MATERIALS

[75] Inventor: Kazunobu Katoh, Kanagawa, Japan

[73] Assignee: Fuji Photo Film Co., Ltd., Kanagawa, Japan

[21] Appl. No.: 152,688

[22] Filed: Nov. 16, 1993

[30] Foreign Application Priority Data

Nov. 16, 1992 [JP] Japan ..... 4-305363
Jan. 12, 1993 [JP] Japan ..... 5-003608

[51] Int. Cl.[6] ..... G03C 1/06

[52] U.S. Cl. ..... 430/264; 430/434; 430/598

[58] Field of Search ..... 430/264, 598, 434

[56] References Cited

U.S. PATENT DOCUMENTS

| | | | |
|---|---|---|---|
| 4,994,364 | 2/1991 | Inoue et al. | 430/264 |
| 5,030,546 | 7/1991 | Takamuki et al. | 430/264 |
| 5,100,761 | 3/1992 | Yagihara et al. | 430/264 |
| 5,175,073 | 12/1992 | Gingello et al. | 430/264 |
| 5,190,847 | 3/1993 | Chan et al. | 430/264 |
| 5,204,214 | 4/1993 | Okamura et al. | 430/264 |
| 5,279,919 | 1/1994 | Okamura et al. | 430/264 |

*Primary Examiner*—Thomas R. Neville
*Attorney, Agent, or Firm*—Sughrue, Mion, Zinn, Macpeak & Seas

[57] ABSTRACT

A photographic material comprises a support and at least one photosensitive layer which comprises a non-chemically sensitized silver halide emulsion containing at least 80 mol % silver chloride based upon the total amount of silver halide in the emulsion. The photosensitive layer or another hydrophilic colloid layer comprises a hydrazine derivative represented by the following General Formula (I):

(I)

In this formula $A_1$ and $A_2$ both represent hydrogen atoms, or one represents a hydrogen atom and the other represents a sulfinic acid group or an acyl group; $R^1$ represents an aliphatic group, an aromatic group or a heterocyclic group, and $R^1$ may or may not be substituted; G represents —CO—, —$SO_2$—, —SO—, —CO-CO—, thiocarbonyl, iminomethylene or —P(O)($R^4$) group; $R^2$ represents a substituted or unsubstituted alkyl group, aryl group, heterocyclic group, amino group, alkoxy group or aryloxy group; at least one of $R^1$ and $R^2$ is a group which promotes adsorption of the hydrazine derivative onto silver halide; $R^4$ represents a hydrogen atom, an aliphatic group, an aromatic group, an alkoxy group, an aryloxy group or an amino group.

The photographic material is subjected to developing in a developer which has a pH of at least 9.0 but no more than 11.0 and which contains at least 0.15 mol/liter of sulfite.

24 Claims, No Drawings

SILVER HALIDE PHOTOGRAPHIC MATERIALS

FIELD OF THE INVENTION

This invention concerns silver halide photographic materials, and especially ultra-high contrast silver halide photographic materials to be used for photographic plate-making purposes.

BACKGROUND OF THE INVENTION

The addition of hydrazine compounds to silver halide photographic emulsions and developers has been described in U.S. Pat. No. 3,730,727 (a developer in which ascorbic acid and hydrazine are combined), in U.S. Patent 3,227,552 (hydrazine is used as an auxiliary developing agent for obtaining direct positive color images), in U.S. Pat. No. 3,386,831 (β-monophenyhydrazides of aliphatic carboxylic acids are included as stabilizers for silver halide sensitive materials), in U.S. Pat. No. 2,419,975, and by Mees in *The Theory of Photographic Process*, third edition, (1966), page 281.

From among these literature references, the fact that high contrast negative images can be obtained by adding hydrazine compounds has been disclosed in particular in U.S. Pat. No. 2,419,975.

In the same patent specification it is disclosed that photographic characteristics which have a very high contrast with a gamma (γ) value exceeding 10 can be obtained if hydrazine compounds are added to a silver chlorobromide emulsion and the material is developed in a high pH developer at a pH value of 12.8. However, a strongly alkaline solution of a pH approaching 13 is susceptible to aerial oxidation and is unstable, and it will not stand-up to long term storage or use.

Attempts have been made to form high contrast images by developing silver halide photosensitive materials which contain hydrazine compounds in developers of a lower pH.

Methods of processing in which development is carried out in a developer of a pH of not more than 11.0 using sensitive materials which contain nucleation development accelerators which have groups which are adsorbed on to silver halide emulsion grains and nucleating agents which have similar adsorption groups have been disclosed in JP-A-1-179939 and JP-A-1-179940. (The term "JP-A" as used herein signifies an "unexamined published Japanese patent application".) However, when compounds which have adsorbing groups are added to a silver halide emulsion there may be a loss of photosensitivity if a certain critical amount is exceeded, development may be inhibited or the action of other useful additives which are adsorbed may be impeded. So the amount which is used is limited, and satisfactory high contrast properties cannot be realized.

Hydrazine compounds which have ethylene oxide repeating units and hydrazine compounds which have pyridinium groups have been disclosed in U.S. Pat. Nos. 4,998,604 and 4,994,365. However, as is clear from the illustrative examples provided, the high contrast properties are inadequate and it is difficult to obtain the $D_{max}$ which is required and high contrast under practical development processing conditions.

Furthermore, with nucleation type high contrast sensitive materials in which hydrazine derivatives are used, the variation in photographic properties which accompanies any change in developer pH is considerable. The developer pH varies greatly, being increased by aerial oxidation of the developer and concentration due to evaporation of water and decreased by the absorption of carbon dioxide from the air for example. Hence, attempts have been made to reduce the developer pH dependence of photographic performance.

As mentioned above, it has not been possible to obtain a sensitive material which exhibits satisfactory high contrast properties even when processed in a developer of a pH less than 11 and with which the developer pH dependence of photographic performance is slight.

More precisely, the dot to dot sensitive materials (contact sensitive material) which are used in light rooms make use of a silver halide emulsion in which non-chemically sensitized silver chloride is used for the photosensitive layer. But even if the above hydrazine derivatives are used, the contrast is not hardened and there is the problem that if the contrast is hardened then the developer pH dependence is considerable. Moreover, in a contact sensitive material system, dyes are added to the photosensitive emulsion layers and other hydrophilic colloid layers to provide increased safety when the materials are being handled under fluorescent lighting from which the UV light has been filtered, and it is difficult to increase contrast because increased contrast is impeded by these dyes.

SUMMARY OF THE INVENTION

Hence, an object of this present invention is first to provide silver halide photographic materials with which it is possible to obtain photographic properties of very hard negative gradation with a gamma value exceeding 10 using a stable developer.

A second object of the invention is to provide silver halide photographic materials for dot to dot work in a light room with which the developer pH dependence of the photographic characteristics is slight.

A third object of the invention is to provide silver halide photographic materials for dot to dot work in a light room with which contrast can be increased in a developer of a pH not more than 11.

These and other objects of the invention have been realized by means of a silver halide photographic material, having at least one photosensitive layer which contains a non-chemically sensitized silver halide emulsion containing at least 80 mol % silver chloride. A hydrazine derivative which can be represented by General Formula (I) indicated below is included in the photosensitive layer or in another hydrophilic colloid layer. The material has been developed in a developer which has a pH of at least 9.0 but not more than 11.0 and which contains at least 0.15 mol/liter of sulfite.

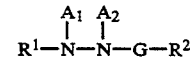

General Formula (I)

In this formula, $A_1$ and $A_2$ both represent hydrogen atoms or one represents a hydrogen atom and the other represents a sulfinic acid residual group or an acyl group. $R^1$ represents an aliphatic group, an aromatic group or a heterocyclic group, and these may or may not be substituted groups. G represents a —CO—, —$SO_2$—, —SO—, —COCO—, thiocarbonyl, iminomethylene or —P(O)($R^4$)— group. $R^2$ represents a substituted or unsubstituted alkyl group, aryl group, heterocyclic group, amino group, alkoxy group or aryloxy group.

At least one of $R^1$ and $R^2$ contains a group which promotes adsorption of the hydrazine derivative on to silver halide. $R^4$ represents a hydrogen atom, an aliphatic group, an aromatic group, an alkoxy group, an aryloxy group or an amino group.

DETAILED DESCRIPTION OF THE INVENTION

The compounds represented by general formula (I) are described in more detail below.

In general formula (I), the aliphatic groups represented by $R^1$ are linear chain, branched or cyclic alkyl groups, alkenyl groups or alkynyl groups having 4 to 30, preferably 4 to 20 carbon atoms.

The aromatic groups represented by $R^1$ are single ring or double ring aryl groups having 6 to 50, preferably 8 to 34 carbon atoms, for example phenyl or naphthyl groups.

The heterocyclic groups of $R^1$ are three to ten membered saturated or unsaturated heterocyclic groups having 6 to 50, preferably 8 to 34 carbon atoms which contain at least one N, O or S atom. They may be single rings or they may take a form in which they are rings which are condensed with other aromatic or heterocyclic rings. Five or six membered aromatic heterocyclic groups are preferred as heterocyclic groups. For example, those which include a pyridyl group, an imidazolyl group, a quinolinyl group, benzimidazolyl group, a pyrimidyl group, pyrazolyl group, isoquinolinyl group, a thiazolyl group or a benzthiazolyl group are preferred.

Aromatic groups, nitrogen containing heterocyclic groups and groups which can be represented by the following General Formula (b) are preferred for $R^1$.

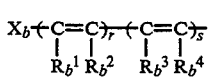

General Formula (b)

In this formula, $X_b$ represents an aromatic group or a nitrogen containing heterocyclic group, $R_b^1$ to $R_b^4$ each represents a hydrogen atom, a halogen atom or an alkyl group, and $X_b$ and $R_b^1$ to $R_b^4$ may have substituent groups in those cases where this is possible. Moreover, r and s represent 0 or 1.

Aromatic groups are more preferred for $R^1$ and aryl groups are especially desirable.

$R^1$ may be substituted with substituent groups. Typical substituent groups include, for example, alkyl groups, aralkyl groups, alkenyl groups, alkynyl groups, alkoxy groups, aryl groups, substituted amino groups, aryloxy groups, sulfamoyl groups, carbamoyl groups, alkylthio groups, arylthio groups, sulfonyl groups, sulfinyl groups, hydroxy groups, halogen atoms, cyano groups, sulfo groups and carboxyl groups, alkyl and aryl oxycarbonyl groups, acyl groups, alkoxycarbonyl groups, acyloxy groups, carboxamido groups, sulfonamido groups, nitro groups, and groups which can be represented by the General Formula (c) indicated below.

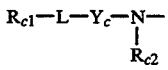

General Formula (c)

In formula (c), $Y_c$ represents —CO—, —$SO_2$—, —P(O)($R_{c3}$)— (where $R_{c3}$ represents an alkoxy group having 1 to 12 carbon atoms or an aryloxy group having 6 to 12 carbon atoms) or —OP(O)($R_{c3}$)—, and L represents a single bond, —O—, —S— or —$NR_{c4}$— (where $R_{c4}$ represents a hydrogen atom, an alkyl group having 1 to 12 carbon atoms or an aryl group having 6 to 12 carbon atoms).

$R_{c1}$ and $R_{c2}$ represent hydrogen atoms, aliphatic groups having 3 to 28 carbon atoms, aromatic groups having 6 to 50 carbon atoms or heterocyclic groups having 6 to 50 carbon atoms, and they may be the same or different, or they may be joined together to form a ring.

Furthermore, $R^1$ may include one or more groups of general formula (c).

In general formula (c), the aliphatic groups represented by $R_{c1}$ are linear chain, branched or cyclic alkyl groups, alkenyl groups or alkynyl groups having 3 to 28 carbon atoms.

The aromatic groups represented by $R_{c1}$ are single ring or double ring aryl groups having 6 to 50 carbon atoms, for example phenyl or naphthyl groups.

The heterocyclic groups of $R_{c1}$ are from three to ten membered saturated or unsaturated heterocyclic rings having 6 to 50 carbon atoms which contain at least one N, O or S atom, and they may be single rings or they may take a form in which they are rings which are condensed with other aromatic or heterocyclic rings. Five or six membered aromatic heterocyclic groups are preferred as heterocyclic groups. For example, those which include a pyridyl group, an imidazolyl group, a quinolinyl group, benzimidazolyl group, a pyrimidyl group, pyrazolyl group, isoquinolinyl group, a thiazolyl group or a benzthiazolyl group are preferred.

$R_{c1}$ may be substituted with substituent groups. Those indicated below can be cited as examples of substituent groups. These groups may be further substituted.

For example, there are alkyl groups, aralkyl groups, alkenyl groups, alkynyl groups, alkoxy groups, aryl groups, substituted amino groups, acylamino groups, sulfonylamino groups, ureido groups, urethane groups, aryloxy groups, sulfamoyl groups, carbamoyl groups, alkylthio groups, arylthio groups, sulfonyl groups, sulfinyl groups, hydroxy groups, halogen atoms, cyano groups, sulfo groups and carboxyl groups, alkyl and aryl oxycarbonyl groups, acyl groups, alkoxycarbonyl groups, acyloxy groups, carboxamido groups, sulfonamido groups, and nitro groups.

Where possible, these groups may be joined together and form a ring.

The aliphatic groups represented by $R_{c2}$ in general formula (c) are linear chain, branched or cyclic alkyl groups, alkenyl groups or alkynyl groups having 3 to 28 carbon atoms.

The aromatic groups represented by $R_{c2}$ are single ring or double ring aryl groups having 6 to 50 carbon atoms, for example phenyl group. The heterocyclic groups represented by $R_{c2}$ can be cited as those cited for $R_{c1}$ in general formula (C).

$R_{c2}$ may be substituted with substituent groups. The examples of substituent groups cited as such for $R_{c1}$ in general formula (c) can be cited, for example, as substituent groups.

Furthermore, in those cases where it is possible, $R_{c1}$ and $R_{c2}$ may be joined together to form a ring.

A hydrogen atom is preferred for $R_{c2}$.

Moreover, —CO— and —$SO_2$— are especially desirable for $Y_c$ in general formula (c). L is preferably a single bond or —$NR_{c4}$—.

The aliphatic groups represented by $R_{c4}$ in general formula (c) are linear chain, branched or cyclic alkyl groups, alkenyl groups or alkynyl groups having 1 to 12 carbon atoms.

The aromatic groups represented by $R_{c4}$ are single ring or double ring aryl groups having 6 to 12 carbon atoms, for example phenyl group.

$R_{c4}$ may be substituted with substituent groups. The examples of substituent groups cited as such for $R_{c1}$ in general formula (c) can be cited, for example, as substituent groups.

A hydrogen atom is preferred for $R_{c4}$.

The —CO— group and the —COCO— group are preferred for G in general formula (I).

$R^2$ in general formula (I) represents an alkyl group having 1 to 12 carbon atoms, an aryl group having 6 to 12 carbon atoms, a heterocyclic group having 6 to 12 carbon atoms, an amino group having 0 to 8 carbon atoms, an alkoxy group having 1 to 16 carbon atoms or an aryloxy group having 6 to 18 carbon atoms, and these groups may be substituted or unsubstituted groups. The alkyl groups are preferably linear chain or branched alkyl groups of carbon number 1 to 12. The aryl groups are phenyl groups or naphthyl groups, and phenyl groups are especially desirable. Five or six membered ring groups which contain 1 to 4 nitrogen, sulfur or oxygen atoms are preferred as heterocyclic groups.

Electron withdrawing groups are preferred as substituent groups for these groups represented by $R^2$. Those which have a $\sigma_p$ value of at least 0.2 and a $\sigma_m$ value of at least 0.3 are especially desirable.

For example, there are halogen atoms, cyano, nitro, nitrosopolyhaloalkyl and polyhaloaryl groups, alkyl or aryl carbonyl groups, formyl group, alkyl or aryl oxycarbonyl groups, alkylcarbonyloxy groups, carbamoyl groups, alkyl or aryl sulfinyl groups, alkyl or aryl sulfonyl groups, alkyl or aryl sulfonyloxy groups, sulfamoyl groups, phosphino groups, phosphine oxide groups, phosphonic acid ester groups, phosphonic acid amide groups, arylazo groups, amidino groups, ammonio groups, sulfonio groups and electron deficient heterocyclic groups.

$R^1$ and $R^2$ in general formula (I) may have incorporated within them groups which are adsorbed strongly on to the surface of a silver halide grain. Examples include the thiourea groups, heterocyclic thioamido groups, mercapto-hetero-cyclic groups and triazole groups disclosed in U.S. Pat. Nos. 4,385,108 and 4,459,347, JP-A-59-195233, JP-A-59-200231, JP-A-59-201045, JP-A-59-201046, JP-A-59-201047, JP-A-59-201048, JP-A-59-201049, JP-A-61-170733, JP-A-61-270744, JP-A-62-948, JP-A-63-234244, JP-A-61-234245 and JP-A-63-234246.

The preferred groups which promote adsorption on to silver halide in $R^1$ or $R^2$ are absorption promoting groups can be represented by $X_1$—$(L_1)_m$—.

Here, $X_1$ is a group which promotes adsorption on to silver halide and $L_1$ is a divalent linking group. Moreover, m is 0 or 1.

Thioamido groups, mercapto groups, groups which have a disulfide bond and five or six membered nitrogen containing heterocyclic groups can be cited as preferred examples of groups which promote adsorption on to silver halide and which can be represented by $X_1$.

The thioamido groups which promote adsorption represented by $X_1$ are divalent groups which can be represented by —C(S)—amino—. They may be part of a ring structure or they may take the form of a non-cyclic thioamido group. Useful thioamido adsorption promoting groups can be selected from among those disclosed, for example, in U.S. Pat. Nos. 4,030,925, 4,031,127, 4,080,207, 4,245,037, 4,255,511, 4,266,013 and 4,276,364, and in *Research Disclosure* Vol. 151, No. 15162 (November 1976) and *Research Disclosure* Vol. 176, No. 17626 (December 1978).

Actual examples of non-cyclic thioamido groups include thioureido groups, thiourethane groups and dithiocarbamic acid ester groups, and actual examples of cyclic thioamido groups include 4-thiazoline-2-thione, 4-imidazoline-2-thione, 2-thiohydantoin, rhodanine, thiobarbituric acid, tetrazoline-5-thione, 1,2,4-triazoline-3-thione, 1,3,4-thiadiazoline-2-thione, 1,3,4-oxadiazoline-2-thione, benimidazoline-2-thione, benzoxazoline-2-thione and benzothiazoline-2-thione, and these groups may be further substituted.

Aliphatic mercapto groups, aromatic mercapto groups and heterocyclic mercapto groups (in a case where there is a nitrogen atom adjacent to the carbon atom to which the —SH group is bonded this is the same as the cyclic thioamido group to which it is related tautomerically, and actual examples of such groups are the same as those listed above) can be cited as mercapto groups for $X_1$.

Five or six membered nitrogen containing heterocyclic groups comprised of nitrogen, oxygen, sulfur and carbon can be cited as five or six membered nitrogen containing heterocyclic groups which can be represented by $X_1$. Preferred examples from among these groups include benzotriazole, triazole, tetrazole, indazole, benzimidazole, imidazole, benzthiazole, thiazole, benzoxazole, oxazole, thiadiazole, oxadiazole and triazine. These may be substituted further with appropriate substituent groups.

The groups described as substituent groups for $R_1$ can be cited as substituent groups.

From among the groups which can be represented by $X_1$, the cyclic thioamido groups (which is to say, mercapto substituted nitrogen containing heterocyclic groups, for example 2-mercaptothiadiazole, 3-mercapto-1,2,4-triazole, 5-mercaptotetrazole, 2-mercapto-1,3,4-oxadiazole and 2-mercapto-oxazole groups), or the nitrogen containing heterocyclic groups (for example, benzotriazole, benzimidazole and indazole groups) are preferred.

Furthermore, two or more $X_1$—$(L_1)_m$— groups may be included in $R^1$ and/or $R^2$, and they may be the same or different.

An atom or group of atoms including at least one selected from among C, N, S and O forms the divalent linking group which is represented by $L_1$. Actual examples include alkylene groups, alkenylene groups, alkynylene groups, arylene groups, —O—, —S—, —NH—, —N=, —CO—, —$SO_2$— (these groups may have substituent groups), either individually or in combinations.

Actual examples include the following groups:

—CONH—, —NHCONH—, —$SO_2$NH—, —COO—,

—NHCOO—, 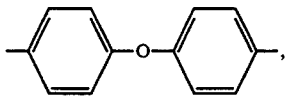 ,

-continued

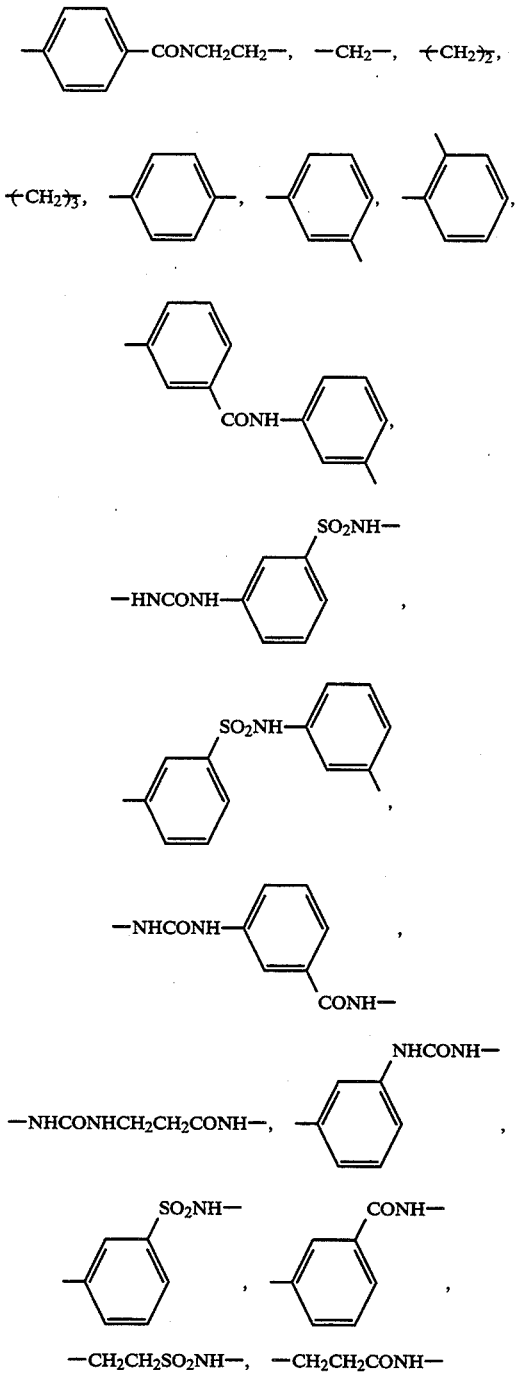

These groups may be substituted with appropriate substituent groups.

The groups described as substituent groups for $R^1$ can be cited as substituent groups.

$A_1$ and $A_2$ are hydrogen atoms, alkylsulfonyl groups or arylsulfonyl groups which have not more than 20 carbon atoms (preferably phenylsulfonyl group or a phenylsulfonyl group substituted in such a way that the sum of the Hammett substituent group constants is at least −0.5), acyl groups which have not more than 20 carbon atoms (preferably benzoyl group or a benzoyl group which is substituted in such a way that the sum of the Hammett substituent group constants is at least −0.5), or a linear chain, branched or cyclic unsubstituted or substituted aliphatic acyl group (which has halogen atoms, ether groups, sulfonamido groups, carboxamido groups, hydroxyl groups or sulfonic acid groups, for example, as substituent groups), and the sulfinic acid groups represented by $A_1$ and $A_2$ are represented in practice by those disclosed in U.S. Pat. No. 4,478,928.

Hydrogen atoms are most desirable for $A_1$ and $A_2$.

A carbonyl group is most desirable for G in general formula (I).

Of the compounds which can be represented by General Formula (I), those which can be represented by General Formula (III) are preferred.

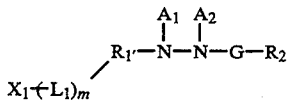

General Formula (III)

In this formula, $R_1'$ is derived by the removal of one hydrogen atom from $R_1$ in general formula (I). Here, at least one out of $R_1'$, $R_2$ and $L_1$ has an amino group or a group which can dissociate into an anion of a pKa value of at least 6 in an aqueous alkali solution. And $X_1$, $L_1$ and m are as defined above.

Of the groups which can dissociate into an anion of a pKa value of at least 6, the substituent groups which can dissociate in to an anion of a pKa value of 8 to 13 are preferred. There is no limitation on these groups provided that they are virtually undissociated in neutral or weakly acidic media and dissociate satisfactorily in aqueous alkali solutions such as developers (preferably of pH 10.5 to 12.3).

For example, a hydroxy group, groups represented by $—SO_2NH—$, hydroxyimino groups, active methylene groups and active methine groups (for example, $—CH_2COO—$, $—CH_2CO—$, $—CH(CN)—COO—$) and such like groups can be cited.

Furthermore, the amino groups may be primary, secondary or tertiary amino groups, and those for which the pKa value of the conjugate acid is at least 6.0 are preferred.

$A_1$, $A_2$, G, $R_2$, $L_1$, $X_1$ and m have the same significance as described in connection with General Formula (I).

From among those compounds which can be represented by General Formula (I), those which can be represented by General Formula (IV) are especially desirable.

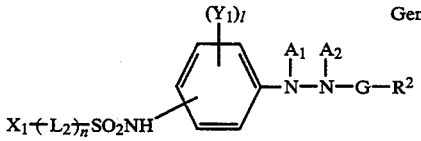

General Formula (IV)

In this formula, $L_2$ is the same as $L_1$ in General Formula (III), $Y_1$ is the same as the substituent groups cited for $R_1$ in General Formula (I), n is 0 or 1, l is 0, 1 or 2, and when l is 2 the $Y_1$ groups may be the same or different.

$A_1$, $A_2$, G, $R_2$, $L_1$ and $X_1$ have the same meaning as described in connection with General Formulae (I) and (III).

Moreover, the $X_1$—$(L_2)_n$—$SO_2NH$ group is preferably substituted in a position para to the hydrazino group.
Actual examples of compounds which can be represented by General Formula (I) are indicated below. However, the invention is not limited to the compounds indicated below.
(I-1)
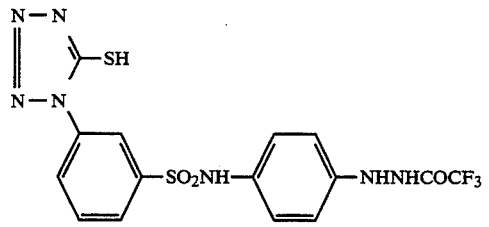
(I-2)
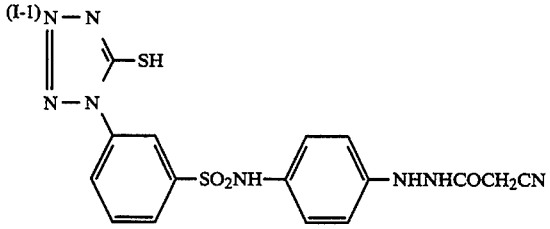
(I-3)
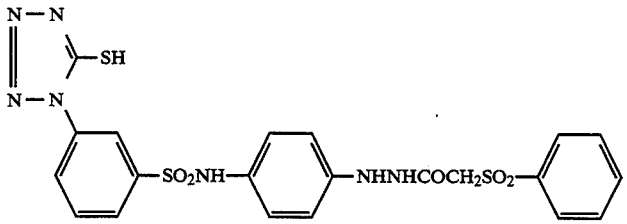
(I-4)
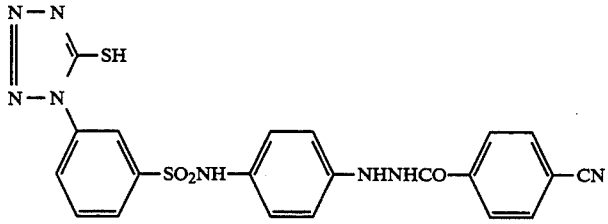
(I-5)
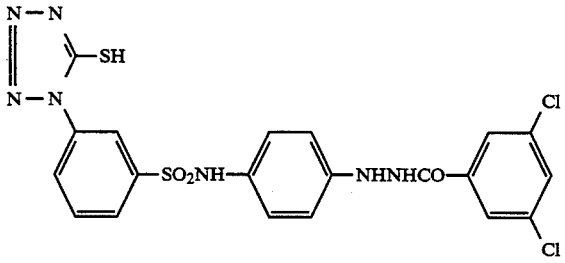
(I-6)
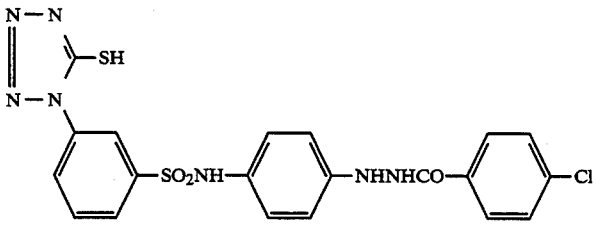
(I-7)
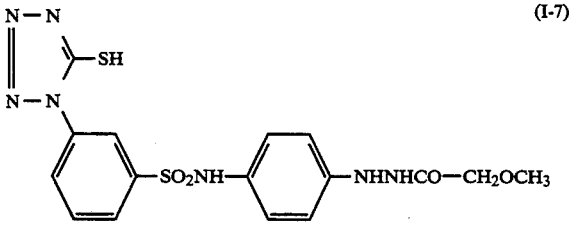
(I-8)
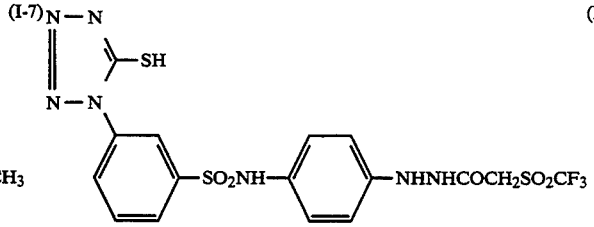

-continued
(I-9)
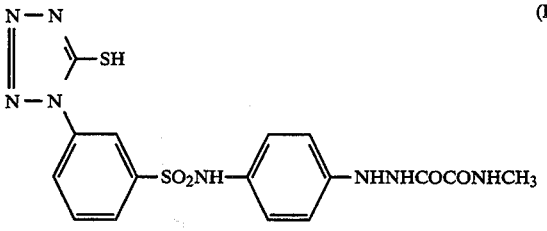
(I-10)
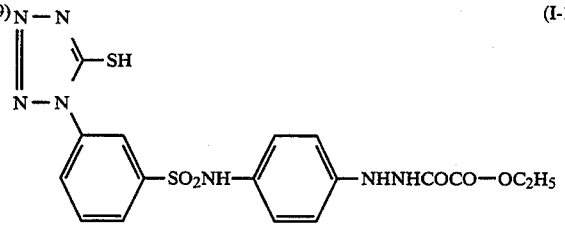
(I-11)
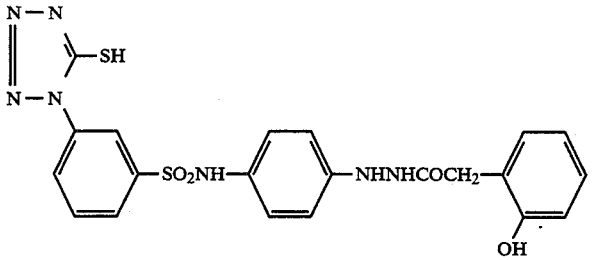
(I-12)
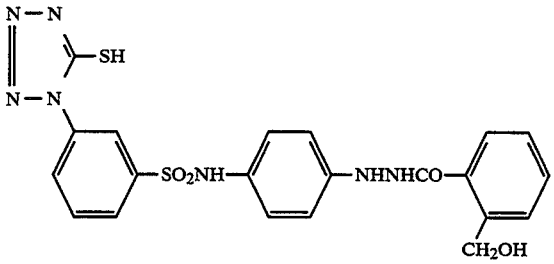
(I-13)
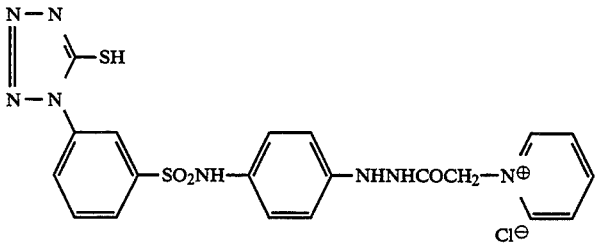
(I-14)
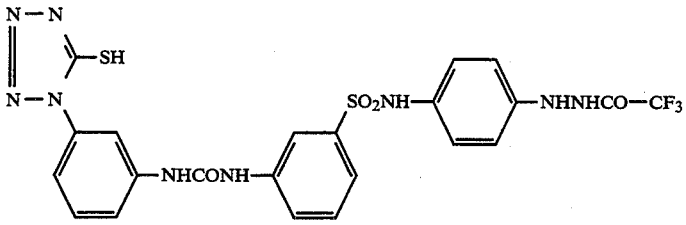
(I-15)
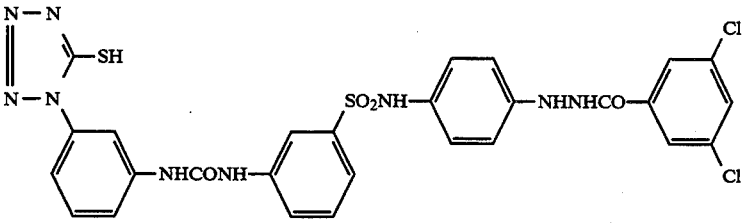

-continued
(I-16)
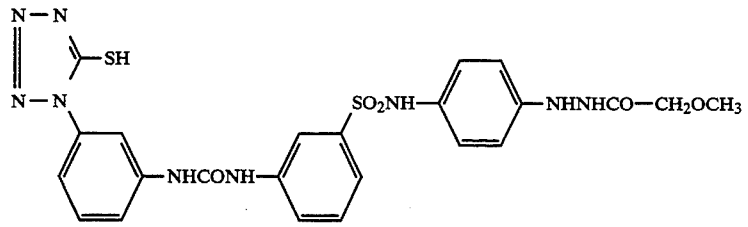
(I-17)
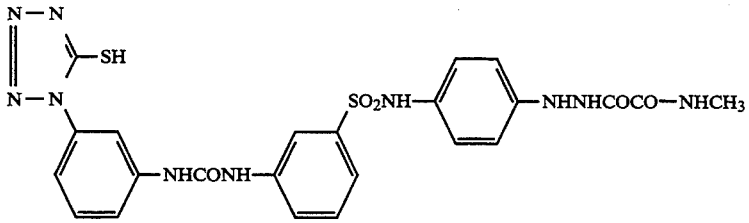
(I-18)
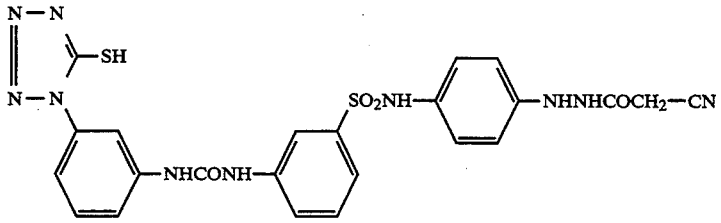
(I-19)
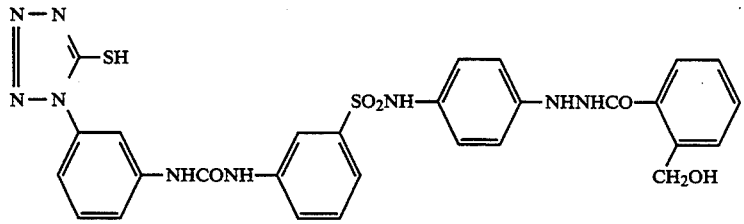
(I-20)
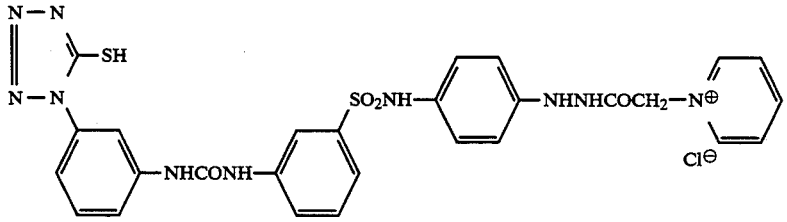
(I-21)
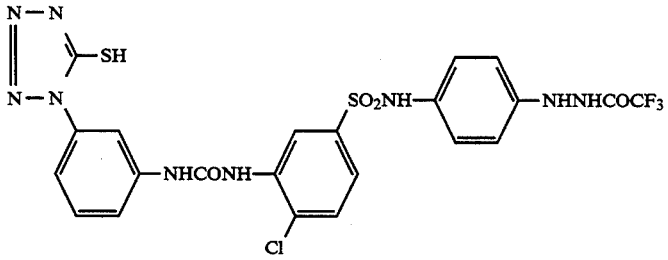
(I-22)
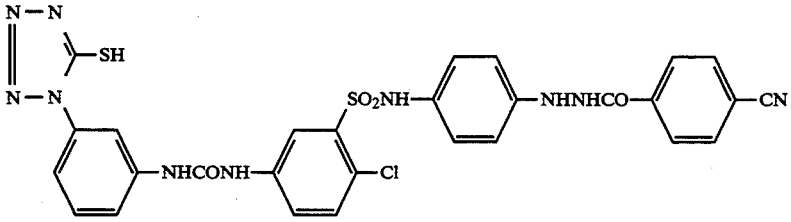

-continued (I-23)

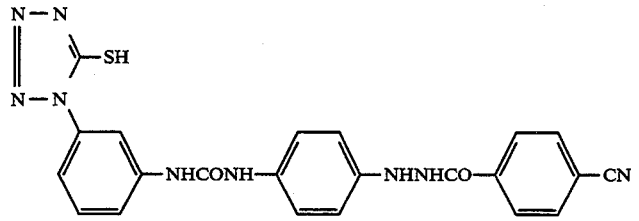

(I-24)

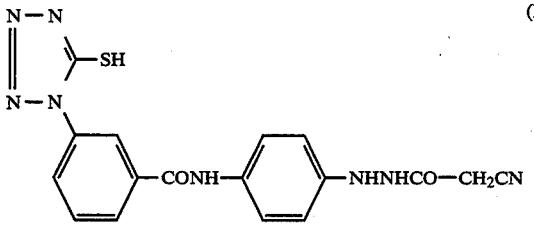

(I-25)

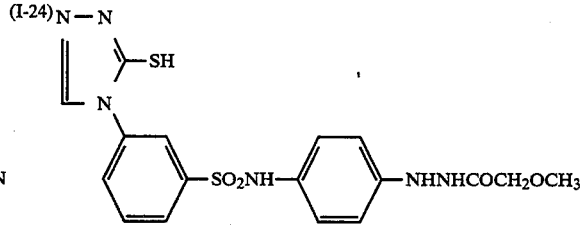

(I-26)

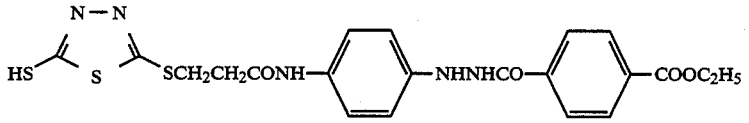

(I-27)

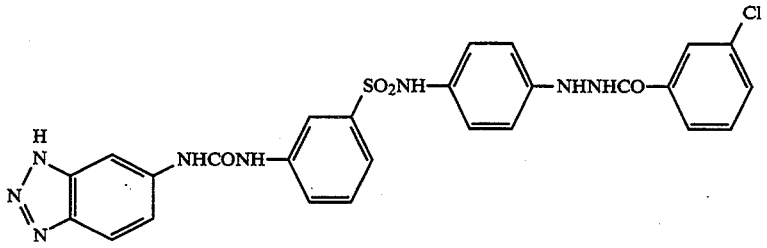

(I-28)

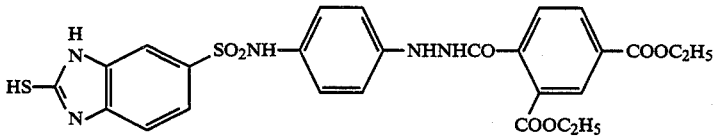

When, in this invention, a compound which can be represented by General Formula (I) is included in a photographic photosensitive material, it is preferably included in a silver halide emulsion layer. But it may be included in another non-photosensitive hydrophilic colloid layer (for example, a protective layer, an intermediate layer, a filter layer or an anti-halation layer). In practice, in those cases where the compound which is being used is water soluble, it may be added to the hydrophilic colloid solution as an aqueous solution, and in those cases where it is sparingly soluble in water it may be added as a solution in an organic solvent which is miscible with water, such as an alcohol, an ester or a ketone.

Alternatively, they may be added in the form of fine oil droplet particles after dissolution in a high boiling point oil using the method known as emulsification and dispersion.

In cases where the addition is made to a silver halide emulsion layer, the addition can be made at any time from the start of chemical ripening until before coating. But addition during the period after the completion of chemical ripening and before coating is preferred. Addition to the coating liquid which is to be used for coating is especially good.

The amount of a compound represented by General Formula (I) of this invention which is included should be selected optimally according to the grain size of the silver halide emulsion, the halogen composition, the method of chemical sensitization, the layer in which the compound is included and its relationship with the silver halide emulsion layer, and the type of anti-fogging compound for example. Experimental methods for this selection are well known to those in the industry. Generally, the use of an amount within the range $10^{-6}$ mol to $1\times10^{-1}$ mol, and especially within the range $1\times10^{-5}$ to $1\times10^{-2}$ mol, per mol of silver halide, is preferred.

Various known dyes can be added to a photosensitive emulsion layer or other hydrophilic colloid layer of this invention. The dyes described from line 1 to line 18 of the lower left column on page 17 of JP-A-2-103536 can be used as water soluble dyes.

The dyes disclosed in JP-A-63-396039 and JP-A-63-280246 react with developer components, form diffusible dyes and are decolorized. They are fixed and used in the layer to which they are added. Alternatively, dyes which have been dispersed in the form of fine solid particles can be used.

The compounds of General Formulae (V) to (XI) indicated below can be used as preferred solid dyes which can be dispersed the form of fine crystals in this invention.

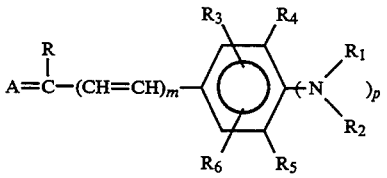

General Formula (V)

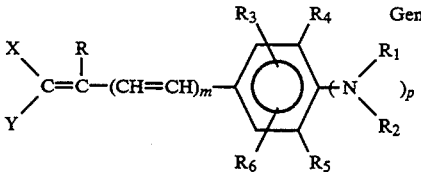

General Formula (VI)

$A{=}L_1{-}(L_2{=}L_3)_n{-}A'$ General Formula (VII)

$A{=}L_1{-}(L_2{=}L_3)_{2-q}{=}B$ General Formula (VIII)

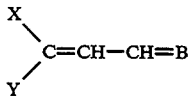

General Formula (IX)

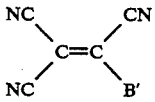

General Formula (X)

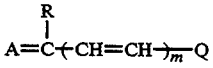

General Formula (XI)

In these formulae, A and A′ may be the same or different, each representing an acidic nucleus, B represents a basic nucleus, and X and Y may be the same or different, each representing an electron withdrawing group. R represents a hydrogen atom or an alkyl group, $R_1$ and $R_2$ each represent an alkyl group, an aryl group, an acyl group or a sulfonyl group, and $R_1$ and $R_2$ may be joined together to form a five or six membered ring. $R_3$ and $R_6$ each represent a hydrogen atom, a hydroxy group, a carboxyl group, an alkyl group, an alkoxy group or a halogen atom, $R_4$ and $R_5$ each represent a hydrogen atom or a group of non-metal atoms which is required for $R_1$ and $R_4$, or $R_2$ and $R_5$, to be joined together to form a five or six membered ring. $L_1$, $L_2$ and $L_3$ each represent a methine group. Moreover, m represents 0 or 1, n and q each represent 0, 1 or 2, and p represents 0 or 1. When p is 0, $R_3$ represents a hydroxy group or a carboxyl group and $R_4$ and $R_5$ represent hydrogen atoms. B′ represents a heterocyclic group which has a carboxyl group, a sulfamoyl group or a sulfonamido group. Q represents a heterocyclic group.

However, the compounds represented by General Formulae (V) to (XI) have within the molecule at least one dissociable group for which the pKa value in a 1:1 by volume mixed solvent-comprising water and ethanol is within the range 4 to 11.

In practise, the dyes which can be used as solid dispersions include those which have been disclosed, for example, in International Patent WO88/04797, European Patents EP 0274723A1, 276,566 and 299,435, JP-A-52-92716, JP-A-55-155350, JP-A-55-155351, JP-A-61-205934, JP-A-48-68623, JP-A-2-282244, JP-A-3-167546, U.S. Pat. Nos. 2,527,583, 3,486,897, 3,746,539, 3,933,798, 4,130,429 and 4,040,841, and in Japanese Patent Application Nos. 4-50874.

The dyes which are used in the invention can be prepared easily in accordance with the methods disclosed in the abovementioned patents and on the basis of these methods.

The preferred dyes in this invention have an absorbance in a wavelength region which is part of the wavelength region to which the photosensitive silver halide emulsion layer is photosensitive.

Actual examples of dyes are indicated below. However, the invention is not limited to the compounds indicated below.

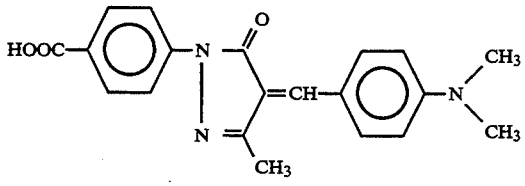

(V-1)

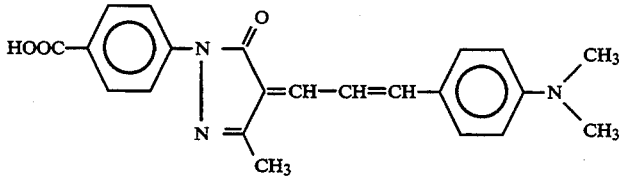

(V-2)

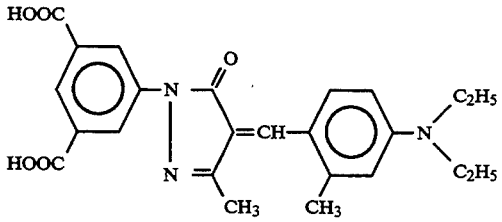

(V-3)

-continued
(V-4)
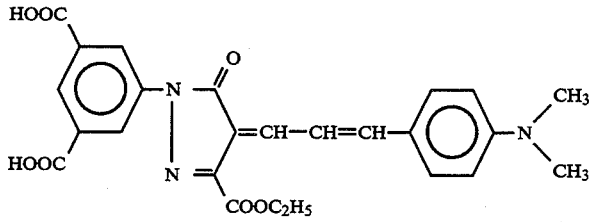
(V-5)
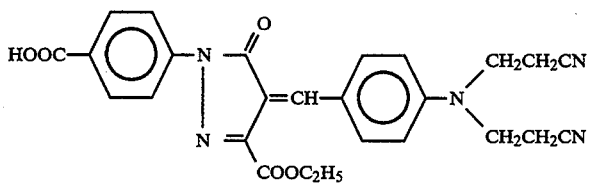
(V-6)
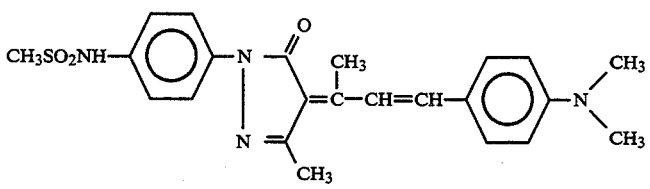
(V-7)
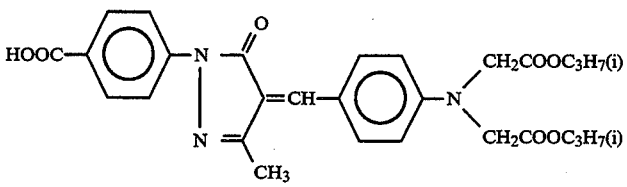
(V-8)
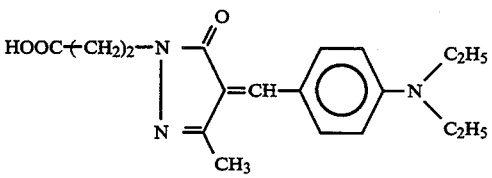
(V-9)
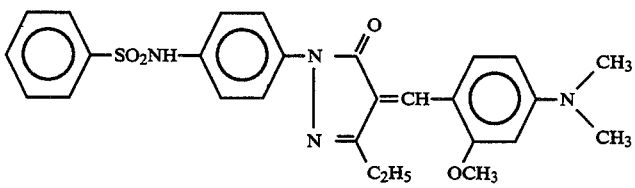
(V-10)
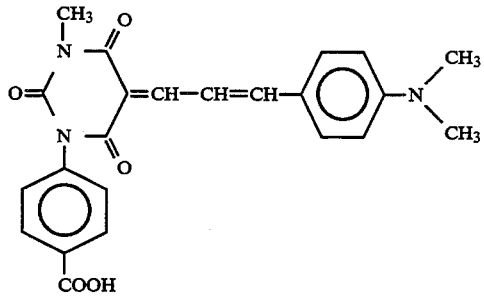

-continued
(V-11)
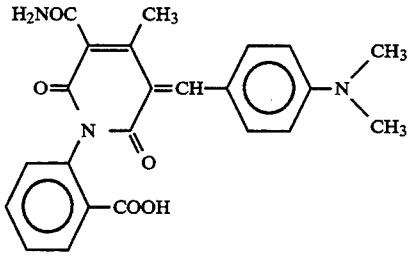
(V-12)
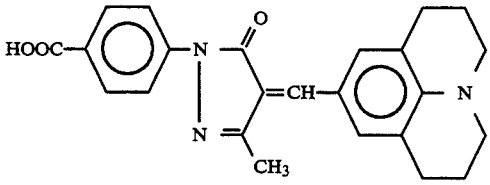
(V-13)
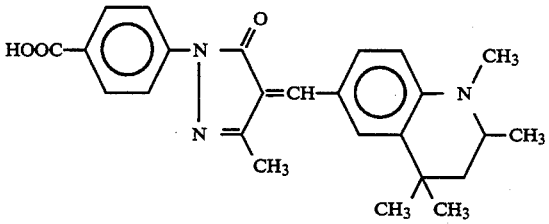
(V-14)
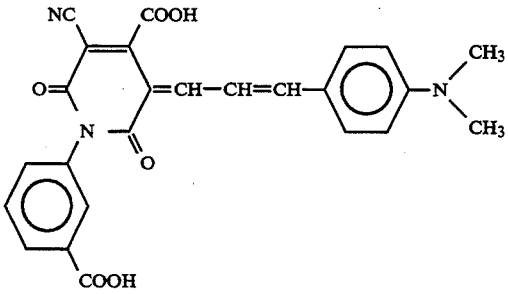
(V-15)
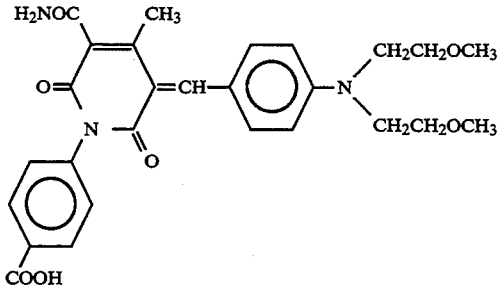
(V-16)
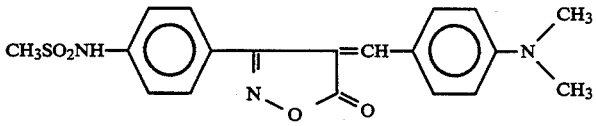
(V-17)
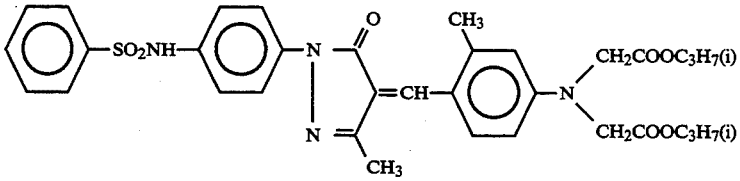

-continued
(V-18)
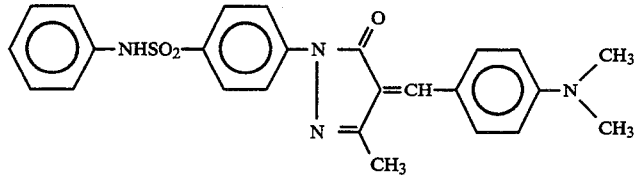
(V-19)
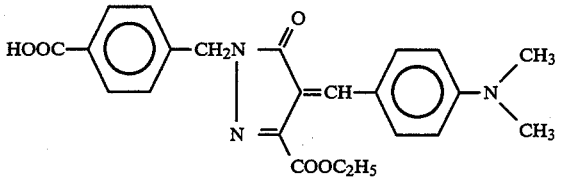
(V-20)
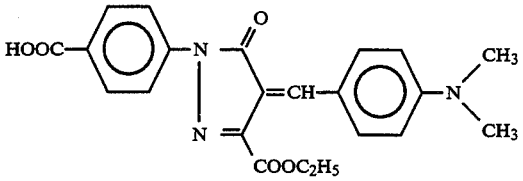
(VI-1)
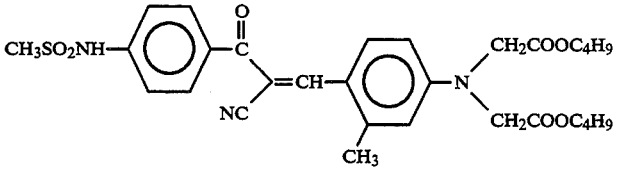
(VI-2)
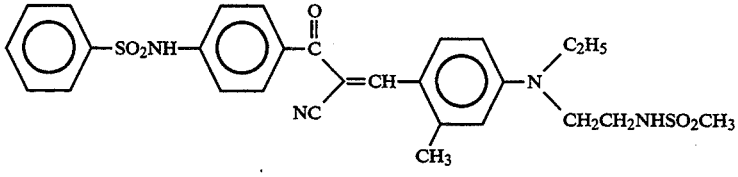
(VI-3)
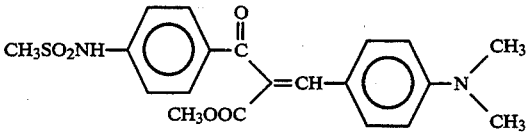
(VI-4)
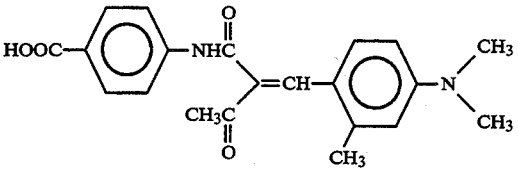
(VI-5)
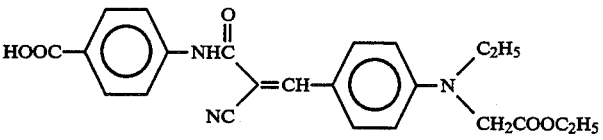
(VI-6)
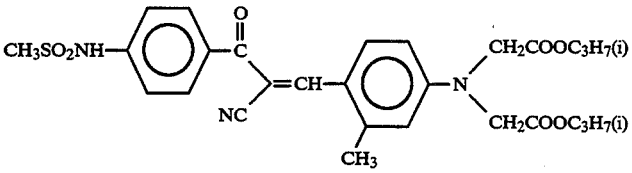

-continued
(VII-1)
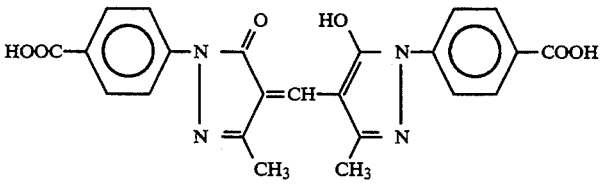
(VII-2)
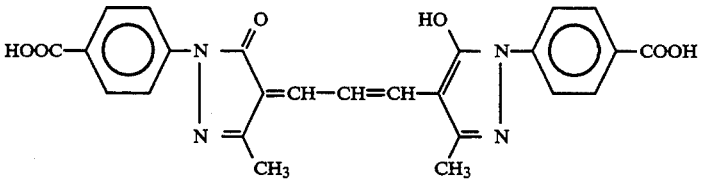
(VII-3)
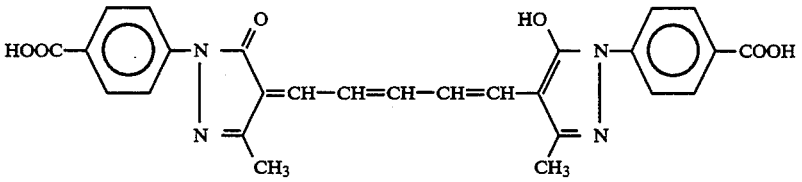
(VII-4)
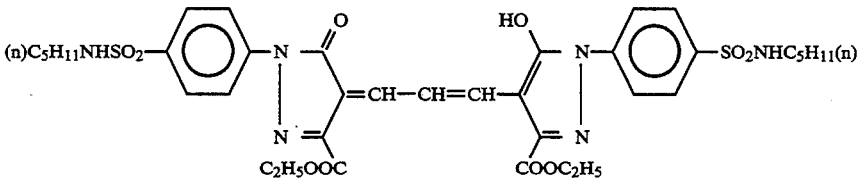
(VII-5)
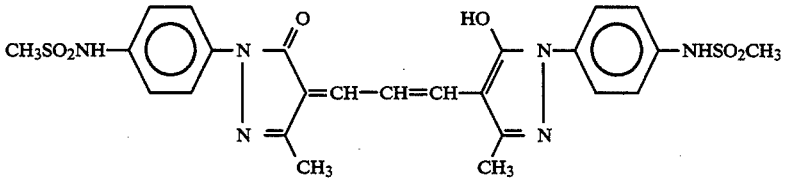
(VII-6)
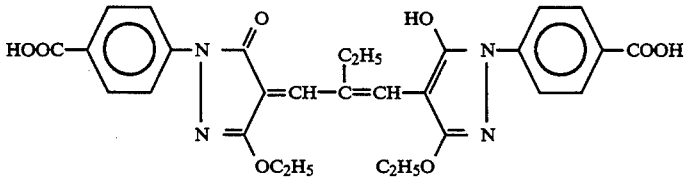
(VII-7)
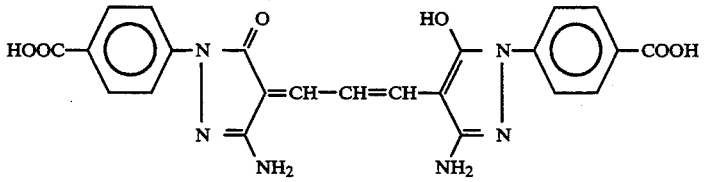
(VII-8)
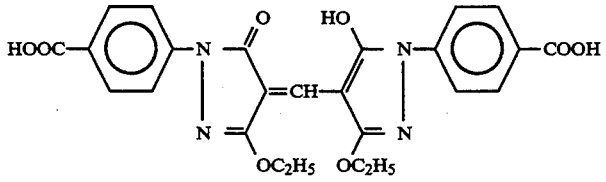

-continued
(VII-9)
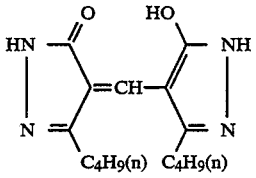
(VII-10)
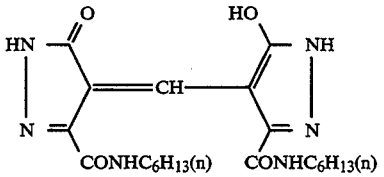
(VIII-1)
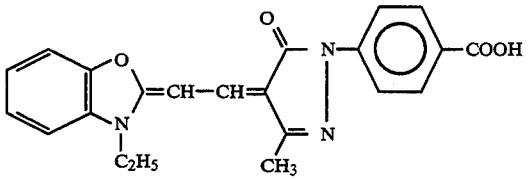
(VIII-2)
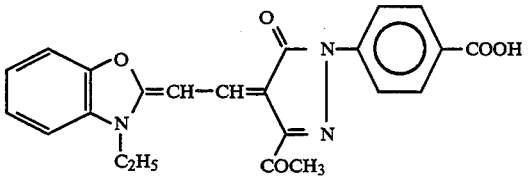
(VIII-3)
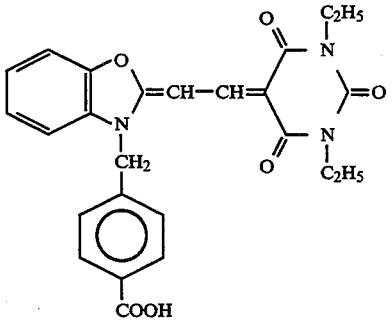
(VIII-4)
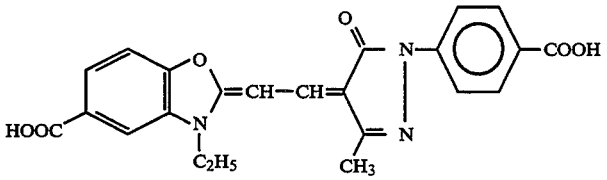
(VIII-5)
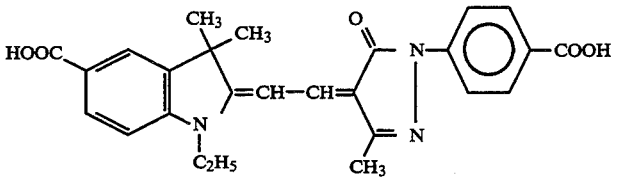

-continued
(VIII-6)
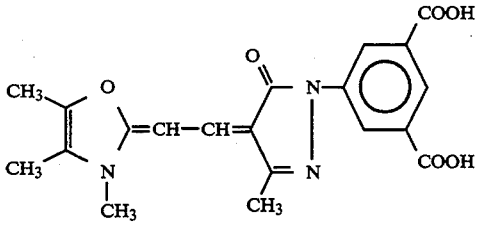
(VIII-7)
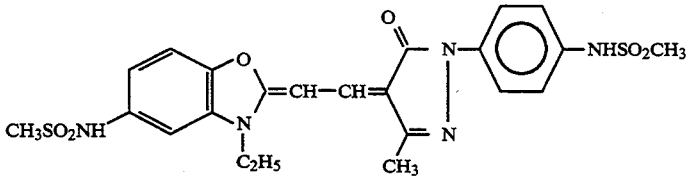
(VIII-8)
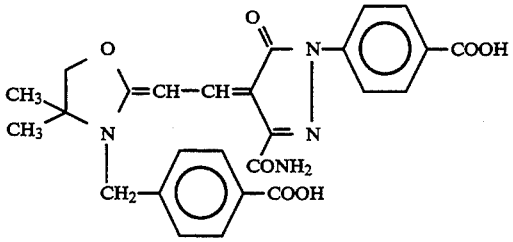
(VIII-9)
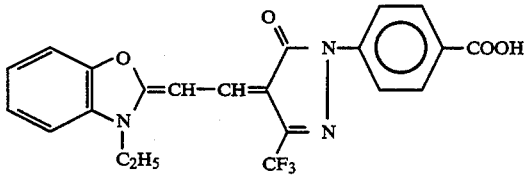
(IX-1)
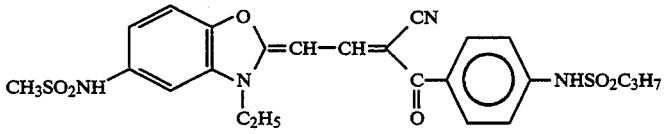
(IX-2)
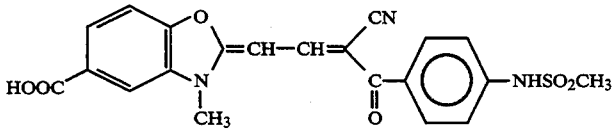
(IX-3)
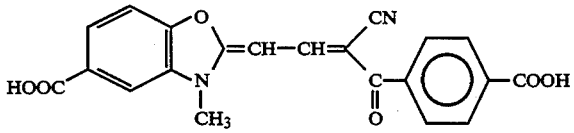
(IX-4)
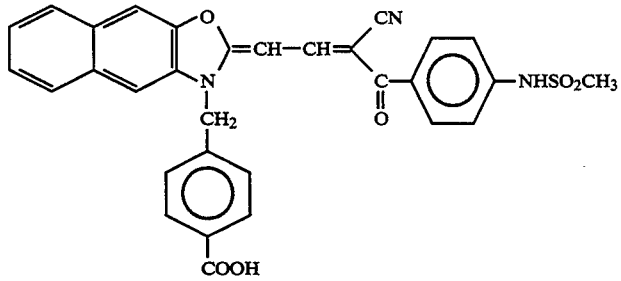

-continued
(IX-5)
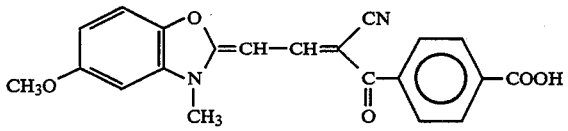
(IX-6)
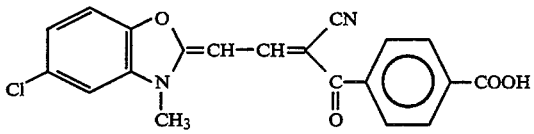
(IX-7)
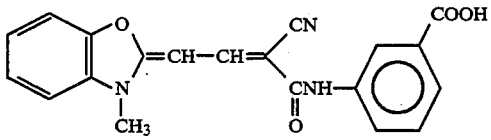
(X-1)
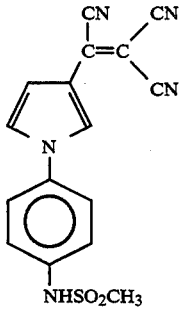
(X-2)
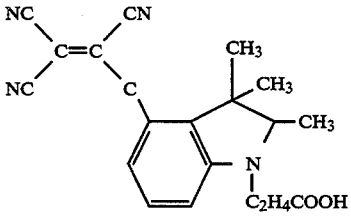
(X-3)
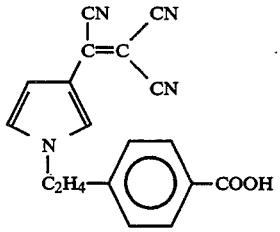
(X-4)
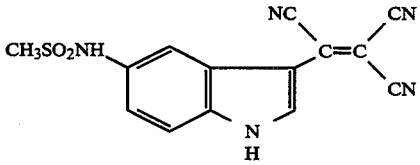

-continued
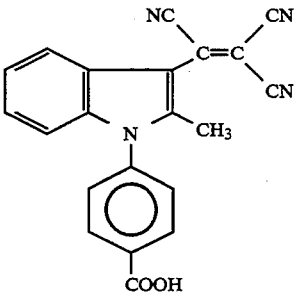
(X-5)
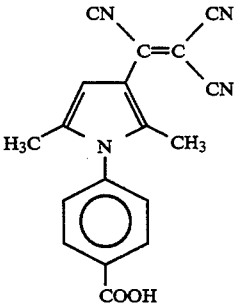
(X-6)
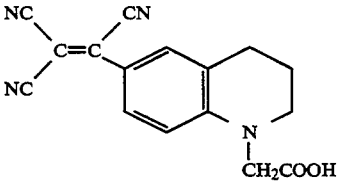
(X-7)
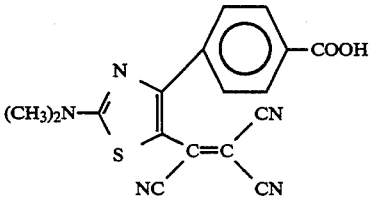
(X-8)
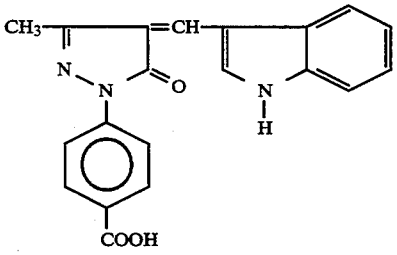
(XI-1)
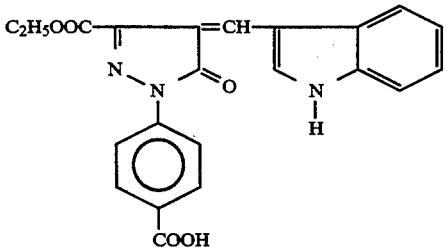
(XI-2)

-continued (XI-3)

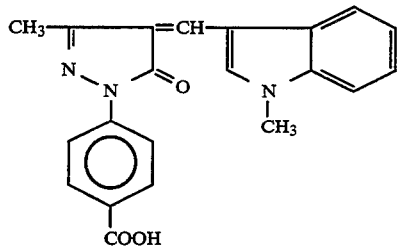

(XI-4)

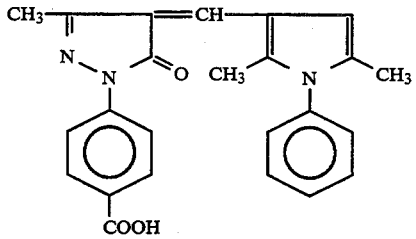

(XI-5)

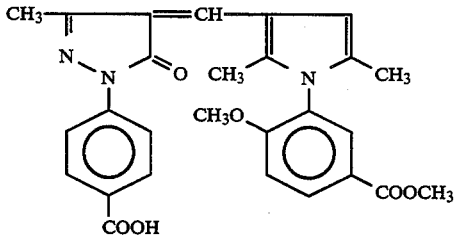

(XI-6)

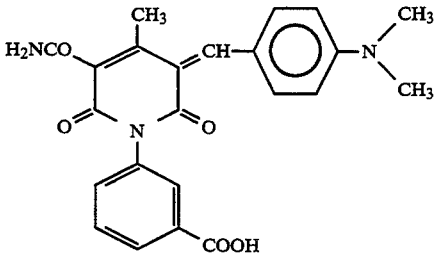

(XI-7)

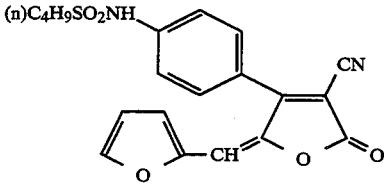

Methods for the dispersion of the dyes of this invention have been disclosed, for example, in International Patent (WO) 88/04794, European Patent (EP) 0276566A1 and JP-A-63-197943. The method in which they are pulverized mechanically in a ball mill or sand mill, colloid mill, etc., and stabilized with a surfactant and gelatin, and methods in which the dye is dissolved in an alkali solution and precipitated by reducing the pH can be used. However, this invention is not limited to these methods.

The dyes of this invention in a dispersion have an average particle size of not more than 10 μm, preferably not more than 2 μm, and most desirably not more than 0.5 μm.

The amount of dye used is 1 to 1000 mg per square meter, and preferably 1 to 800 mg per square meter, of photosensitive material.

When dispersed solid compounds of General Formula (V) to (XI) are used as anti-halation dyes or light filtering dyes they can be used in any amount which is effective, and their use so that the optical density is within the range 0.05 to 3.5 is desirable. Furthermore, they can be used .in an emulsion layer in any amount which is effective as an anti-irradiation dye. The addition can be made at any stage before coating.

Gelatin is a typical hydrophilic colloid, but any of the other hydrophilic colloids known in the past to be useful for photographic purposes can be used.

The halogen composition of the silver halide emulsion which is used in this invention has a silver chloride content of at least 80 mol %, and it may consist of a silver chlorobromide, silver chloride or silver iodochlorobromide. The silver iodide content is not more than 3 mol %, and preferably not more than 0.5 mol %.

A silver chloride content of at least 95 mol % is especially desirable.

The various methods known in the field of silver halide photographic photosensitive materials can be used for preparing the silver halide emulsions which are used in this invention. For example, they can be prepared using the methods described, for example, by P. Glafkides in *Chimie et Physique Photographique* (Paul Monte, 1967), by G. F. Duffin in *Photographic Emulsion Chemistry* (The Focal Press, 1966), and by V. L. Zalikman et al. in *Making and Coating Photographic Emulsion* (The Focal Press, 1964).

The emulsions of this invention are preferably monodisperse emulsions, and the variation coefficient is not more than 20%, and most desirably not more than 15%.

The average grain size of the grains in the mono-disperse silver halide emulsion is not more than 0.5 μm, and more desirably 0.05 μm to 0.30 μm.

Single sided mixing methods, simultaneous mixing methods and combinations of such methods can be used for reacting the water soluble silver salt (aqueous silver nitrate solution) and the water soluble halogen salt. The so-called controlled double jet method in which the pAg value of the liquid phase in which the silver halide is being formed is held constant can be used as one type of simultaneous mixing method. Furthermore, the grains are preferably formed using a so-called silver halide solvent such as ammonia, thioether or tetra-substituted thiourea.

The tetra-substituted thioureas are preferred, and these have been disclosed in JP-A-53-82408 and JP-A-55-77737. The preferred thiourea compounds are tetramethylthiourea and 1,3-dimethyl-2-imidazolidinethione.

The production of silver halide emulsions which have a regular crystalline form and a narrow grain size distribution is simple with the method of grain formation in which the controlled double jet method and a silver halide solvent is used, and this is a useful means of preparing an emulsion which is to be used in this invention.

The mono-disperse emulsion preferably has a regular crystalline form such as a cubic, octahedral or tetradecahedral form, and a cubic form is especially desirable.

The silver halide grains may be such that the interior parts and the surface layer which are comprised of a uniform phase, or they may be comprised of different phases.

The inclusion of transition metal complexes is desirable in the silver halide emulsions which are used in this invention. Rh, Ru, Re, Os, Ir, Cr and the like can be cited as such transition metals. Nitrosyl and thionitrosyl ligands, halide ligands, (fluoride, chloride, bromide, iodide), cyanide ligand, cyanate ligand, thiocyanate ligand, selenocyanate ligand, tellurocyanate ligand, azido ligand and aquo ligand can be cited as ligands. In case of an aquo ligand it is desirable that one or two aquo ligands configurate to metal. The most desirable metal complexes are the halogen, nitrosyl or thionitrosyl complexes of rhodium and ruthenium.

As well as complexes, metal salts in any form such as that of a simple salt can be added during the preparation of the grains in order to dope the silver halide grains with transition metal ions.

Rhodium mono-chloride, rhodium dichloride, rhodium trichloride and ammonium hexachlororhodiumate for example can be cited as rhodium salts, but water soluble halogen complex compounds of trivalent rhodium, for example hexachlororhodium(III) acid and its salts (for example, its ammonium salt, sodium salt or potasslum salt), are preferred.

The transition metal complexes indicated below are preferred.

(1) $[Ru(NO)Cl_5]^{-2}$
(2) $[Ru(NO)_2Cl_4]^{-1}$
(3) $[Ru(NO)(H_2O)Cl_4]^{-1}$
(4) $[Rh(NO)Cl_5]^{-2}$
(5) $[Re(NO)Cl_5]^{-2}$
(6) $[Re(NO)CN_5]^{-2}$
(7) $[Re(NO)ClCN_4]^{-2}$
(8) $[Rh(NO)_2Cl_4]^{-1}$
(9) $[Rh(NO)(H_2O)Cl_4]^{-1}$
(10) $[Rh(NO)CN_5]^{-2}$
(11) $[Ru(NO)Br_5]^{-2}$
(12) $[Rh(NS)CN_5]^{-2}$
(13) $[Os(NO)Cl_5]^{-2}$
(14) $[Cr(NO)Cl_5]^{-3}$
(15) $[Re(NO)_2Cl_4]^{-1}$
(16) $[Os(NS)Cl_4(TeCN)]^{-2}$
(17) $[Ru(NS)I_5]^{-3}$
(18) $[Re(NS)Cl_4(SeCN)]^{-2}$
(19) $[Os(NS)Cl(SCN)_4]^{-2}$
(20) $[Ir(NO)Cl_5]^{-3}$

The abovementioned Complexes (1) to (20) all have an ammonium, sodium or potassium ion as the counterion.

The amount of these transition metal complexes which is added is within the range $1.0\times10^{-8}$ to $1.0\times10^{-3}$ mol per mol of silver halide. It is preferably within the range $1.0\times10^{-7}$ mol to $1.0\times10^{-4}$ mol per mol of silver halide.

The use of a silver halide emulsion which has not been subjected to chemical sensitization, such as gold sensitization for example, is desirable in the present invention for providing safe-light safety when it is handled in a light room.

It is possible to obtain photographic characteristics of ultra-high contrast using a silver halide photosensitive material of the present invention using a stable developer and without the need for a conventional infectious developer or highly alkaline developer of a pH higher than 11.

That is to say, a silver halide photosensitive material of this invention can provide a negative image of satisfactory ultra-high contrast using a developer which contains at least 0.15 mol/liter of sulfite ion as preservative and which is of pH 9.6 to 11.0, and preferably of pH 10.0 to 11.0.

No special limitation is imposed on the developing agents which can be used in this invention. For example, dihydroxybenzenes (for example hydroquinone), 3-pyrazolidones (for example 1-phenyl-3-pyrazolidone, 4,4-dimethyl-1-phenyl-3-pyrazolidone) and aminophenols (for example, N-methyl-p-aminophenol) can be used either individually or in combinations.

The silver halide photosensitive materials of this invention are especially suitable for processing in developers which contain dihydroxybenzenes as main developing agents and 3-pyrazolidones or aminophenols as auxiliary developers. The conjoint use in the developer of 0.05 to 0.5 mol/liter of dihydroxybenzenes and not more than 0.06 mol/liter of 3-pyrazolidones or aminophenols is preferred.

Furthermore, an increase in the rate of development and a shortening of the developing time can be realized adding amines to the developer, as disclosed in U.S. Pat. No. 4,269,929.

pH buffers such as alkali metal sulfites, carbonates, borates and phosphates, and development inhibitors and anti-foggants such as iodide and organic anti-foggants (nitroimidazoles or benzotriazoles are especially desirable) can also be included in the developer. Furthermore, hard water softening agents, dissolution promotors, color toners, development accelerators, surfactants (polyalkylene oxides are especially desirable), anti-foaming agents, film hardening agents, and agents for preventing the occurrence of silver contamination of the film (for example 2-mercaptobenzimidazole sulfonic acids) may be included, as required.

Fixers of the type generally used can be used for the fixer. In addition to thiosulfate and thiocyanate, the organic sulfur compounds which are known to have an effect as a fixing agent can be used as fixing agents. Water soluble aluminum salts, for example, may be included in the fixer as film hardening agents.

The processing temperature in the method of this invention is generally selected between 18° C. and 50° C.

The use of an automatic processor for photographic processing is preferred. Even if the total processing time from the introduction of the photosensitive material into the automatic processor until it emerges from the processor is set at 60 to 120 seconds, with the method of this invention it is possible to obtain photographic characteristics with a negative gradation of satisfactorily ultra-high contrast.

The compounds disclosed in JP-A-56-24347 can be used in the developer as agents for preventing the occurrence of silver contamination in this invention. The compounds disclosed in JP-A-61-267759 can be used as dissolution promotors which are added to the developer. Moreover, the compounds disclosed in JP-A-60-93433 or the compounds disclosed in JP-A-62-186259 can be used as the pH buffers which are used in the developer.

No particular limitations are imposed upon the various additives which can be used in the photosensitive materials, and those disclosed in the locations indicated below can be used for example.

| Item | Location |
|---|---|
| 1) Nucleating Agents | Illustrative compounds II-1 - II-22 and general formulae (II-m) - (II-p) from line 13 of the upper right column on page 9 to line 10 of the upper left column on page 16 of JP-A-2-103536, and the compounds disclosed in JP-A-1-179939 |
| 2) Silver Halide Emulsions and Their Preparation | From line 12 of the lower right column on page 20 to line 14 of the lower left column on page 21 of JP-A-2-97937, from line 19 of the upper right column on page 7 to line 12 of the lower left column on page 8 of JP-A-2-12236, and the selenium sensitization method disclosed in JP-A-5-11389 |
| 3) Spectrally Sensitizing Dyes | The spectrally sensitizing dyes disclosed from line 13 of the lower left column to line 4 of the lower right column on page 8 of JP-A-2-12236, from line 3 of the lower right column on page 16 to line 20 of the lower left column on page 17 of JP-A-2-103536, and in JP-A-1-112235, JP-A-2-124560, JP-A-3-7928, JP-A-5-11389 and Japanese Patent Application No. 3-411064. |
| 4) Surfactants | From line 7 of the upper right column to line 7 of the lower right column on page 9 of JP-A-2-12236 and from line 13 of the lower left column on page 2 to line 18 of the lower right column on page 4 of JP-A-2-18542. |
| 5) Anti-foggants | From line 19 of the lower right column on page 17 to line 4 of the upper right column on page 18 of JP-A-2-103536, and the thiosulfinic acid compounds disclosed in JP-A-1-237538. |
| 6) Polymer Latexes | From line 12 to line 20 of the lower left column on page 18 of JP-A-2-103536. |
| 7) Compounds which have Acid Groups | From line 6 of the lower right column on page 18 to line 1 of the upper left column on page 19 of JP-A-2-103536. |
| 8) Matting Agents, Lubricants, Plasticizers | From line 15 of the upper left column on page 19 to line 15 of the upper right column on page 19 of JP-A-2-103536. |
| 9) Film Hardening Agents | From line 5 to line 17 of the upper right column on page 18 of JP-A-2-103536. |
| 10) Binders | From line 1 to line 20 of the lower right column on page 3 of JP-A-2-18542. |
| 11) Anti-black Spotting | The compounds disclosed in U.S. Pat. No. 4,956,257 and JP-A-1-118832. |
| 12) Redox Compounds | The compounds represented by general formula (I) (especially illustrative compounds 1 to 50) of JP-A-2-301743, the general formula (R-1), (R-2) and (R-3) and the illustrative compounds 1 to 75 disclosed on pages 3 to 20 of JP-A-3-174143, and the compounds disclosed in Japanese Patent Application Nos. 3-69466 and 3-15648. |
| 13) Mono-methine Compounds | The compounds of general formula (II) (especially illustrative compounds II-1 to II-26) of JP-A-2-287532. |
| 14) Dihydroxy-benzenes | The compounds disclosed from the upper left column on page 11 to the lower left column on page 12 of JP-A-3-39948, and in EP 452772A. |

The invention is described in practical terms below by means of illustrative examples, but the invention is not limited by these examples.

EXAMPLE 1

Preparation of Emulsion A

An aqueous solution of silver nitrate and an aqueous solution of sodium chloride (containing $5\times10^{-6}$ mol of hexachlororhodium(III) acid, ammonium salt, per mol of silver) were added using the double jet method to, and mixed in, an aqueous gelatin solution of pH 3.0 which was maintained at 40° C., and a silver chloride emulsion comprised of mono-disperse cubic grains of an average grain size 0.15 μm was obtained. After grain formation, $2\times10^{-3}$ mol of 4-hydroxy-6-methyl-1,3,3a,7-tetra-azaindene was added per mol of silver, and the soluble salts were removed by water washing in the usual way. After washing, gelatin was added, sodium chloride and sodium hydroxide were added to adjust to pH=6.0 and pAg=7.6, and $4\times10^{-4}$ mol per mol of silver of 1-phenyl-5-mercapto-tetrazole and $5\times10^{-3}$ mol per mol of silver of 4-hydroxy-6-methyl-1,3,3a,7-tetraazaindene was added as stabilizer. This emulsion contained 110 grams of silver and 55 grams of gelatin per kilogram.

Preparation of Photosensitive Layer Coating Liquid

Emulsion A was divided into equal parts, the hydrazine derivatives of this invention and comparative hydrazine derivatives were added as indicated in Table 1, and 5 mg/m$^2$ of the following compound was added as a nucleation accelerator.

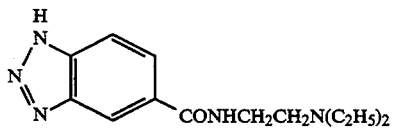

Moreover, the latex disclosed in Example of Manufacture 3 of U.S. Pat. No. 3,525,620 was added in an amount of 300 mg per square meter as a polymer latex, and 1,3-divinylsulfonyl-2-propanol was added in an amount of 100 mg per square meter as a film hardening agent to prepare coating liquids for silver halide emulsion layer purposes.

Preparation of Protective Layer Coating Liquid

The same nucleating agent as that added to the photosensitive layer was added in an amount of 15 mg/m$^2$ to an aqueous gelatin solution, poly(ethyl acrylate) latex was added so that the weight of the solid fraction was 100 mg/m$^2$, and dyes which had been dispersed in a solid form of this invention and water soluble dyes were added as indicated in Table 1.

Preparation of Over-coat Liquid

Amorphous silica matting agent of an average particle size of about 3.0 μm was added in an amount of 40 mg/m$^2$ to a gelatin solution, polyacrylamide was added in an amount of 100 mg/m$^2$, sodium p-dodecylbenzenesulfonate was added in an amount of 40 mg/m$^2$ and $C_8F_{17}SO_3N(C_3H_7)CH_2COOK$ was added as a fluorine based surfactant in an amount of 10 mg/m$^2$ to prepare a coating liquid for protective layer purposes.

Sample Coating

The aforementioned coating liquid for silver halide emulsion layer purposes which contained a hydrazine derivative was coated to provide a coated silver weight of 3.4 g/m$^2$ on a 100 μm poly(ethylene terephthalate) film support, a protective layer was coated over this to provide 0.8 g/m$^2$ of gelatin, and then the over-coat layer was coated over this to provide 0.7 g/m$^2$ of gelatin.

TABLE 1

| | | Hydrazine derivative | | Dye | |
|---|---|---|---|---|---|
| | Sample No. | Compound No. | Amount Added (mol/mol · Ag) | Compound No. | Amount added (mg/m$^2$) |
| Comparative Examples | 1 | Compound A | $2.4\times10^{-3}$ | V-1 | 80 |
| Comparative Examples | 2 | " | " | " | 160 |
| Comparative Examples | 3 | " | " | VII-9 | 80 |
| Comparative Examples | 4 | " | " | " | 160 |
| Comparative Examples | 5 | " | " | XII-1 | 80 |
| Comparative Examples | 6 | " | " | " | 160 |
| Comparative Examples | 7 | Compound B | " | V-1 | " |
| Comparative Examples | 8 | " | " | VII-9 | " |
| Comparative Examples | 9 | " | " | XII-1 | " |
| This Invention | 10 | I-1 | " | V-1 | 80 |
| This Invention | 11 | " | " | " | 160 |
| This Invention | 12 | " | " | VII-9 | 80 |
| This Invention | 13 | " | " | " | 160 |
| This Invention | 14 | " | " | XII-1 | 80 |
| This Invention | 15 | " | " | " | 160 |
| This Invention | 16 | I-4 | " | VII-9 | " |
| This Invention | 17 | " | " | XII-1 | " |
| This Invention | 18 | I-5 | " | VII-9 | " |
| This Invention | 19 | " | " | XII-1 | " |
| This Invention | 20 | " | " | XII-2 | " |
| This | 21 | I-7 | $2.4\times10^{-3}$ | VII-9 | 160 |

TABLE 1-continued

| | Sample No. | Hydrazine derivative Compound No. | Hydrazine derivative Amount Added (mol/mol · Ag) | Dye Compound No. | Dye Amount added ($mg/m^2$) |
|---|---|---|---|---|---|
| Invention | | | | | |
| This Invention | 22 | I-14 | " | " | " |
| This Invention | 23 | I-28 | " | " | " |
| This Invention | 24 | I-1 | " | VII-1 | 80 |
| | | | | VII-9 | 80 |

Compound A

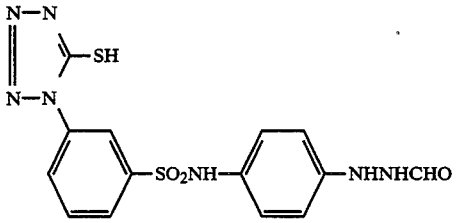

Compound B

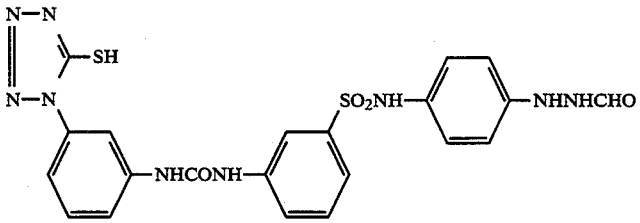

Dye XII-1

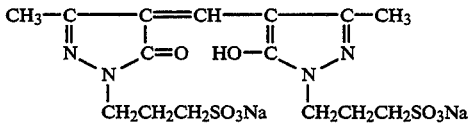

Dye XII-2

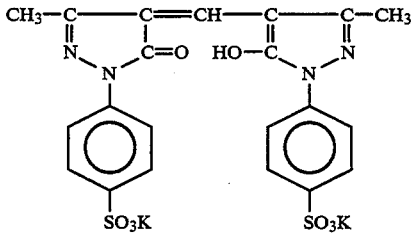

Evaluation of Photographic Properties

Each of the samples which had been prepared was exposed through an optical wedge using a model P-627FM Daylight Printer made by the Dainippon Screen Co., and then they were processed at a development time of 20 seconds at 38 using an FG-680A automatic processor (made by the Fuji Photographic Film Co., Ltd.) in the developer the composition of which is indicated below.

| Developer Composition I | |
|---|---|
| Hydroquinone | 30.0 grams |
| N-Methyl-p-aminophenol | 0.3 |
| Sodium hydroxide | 10.0 |

-continued

| Developer Composition I | |
|---|---|
| Potassium sulfite | 60.0 |
| Ethylenediamine tetra-acetic acid, disodium salt | 1.0 |
| Potassium bromide | 10.0 |
| 5-Methylbenzotriazole | 0.4 |
| 2-Mercaptobenzimidazole-5-sulfonic acid | 0.3 |
| 3-(5-Mercaptotetrazole)benzenesulfonic acid, sodium salt | 0.2 |
| Sodium toluenesulfonate | 8.0 |
| Sodium carbonate | 11.0 |
| Water to make up to | 1 liter |

Adjusted to pH 10.3 with potassium hydroxide solution.

The photographic speed was indicated by a relative value for which the reciprocal of the exposure required to give a density of 3.0 was taken to be 100 in the case of Sample No. (1).

The gamma (γ) value shows the average gradient of the characteristic curve from density 0.3 to density 3.0, and the value was obtained by dividing 2.7 by Δlog E (the difference between the logarithm of the exposure which gave a density of 3.0 and the logarithm of the exposure which gave a density of 0.3). Image characteristics of higher contrast were observed as the numerical value increased.

Furthermore, suitable exposing conditions using an original constructed in the way indicated in FIG. 1 of JP-A-2-293736 such that the part which had an original screen dot area of 50% formed a screen dot area of 50% on the photosensitive material under the aforementioned processing conditions were obtained and a blank text image was formed.

The line width reproduction of the blank text image was observed with a 100 times magnifier. Where the 30 μm lines of the original had been blanked perfectly a score of 5 was awarded, and where the 100 μm lines of the original became blurred a score of 1 was awarded, the evaluation being made in a total of five stages.

The variation in photographic performance due to developer pH fluctuation was evaluated. The pH was varied by subjecting the developer to aerial oxidation and by processing fatigue.

The amount of potassium hydroxide solution added to Developer Composition I was adjusted to provide Developer II having a pH of 10.5. The extent of the variation was quantified by the difference in photographic speed (Δlog E) obtained on processing in Developer II and Developer I. The variation is reduced as Δlog E approaches 0 and this is desirable.

Safe-light safety was evaluated with Sample Nos. 10 to 24 which exhibited ultra-high contrast with a gamma (γ) value of more than 10.

Safety with respect to safe-lighting was monitored by leaving each sample to stand for 0 to 60 minutes at a brightness of 200 lux using an anti-fading fluorescent lamp (FLR40SW-DL-X, NU/M) made by Toshiba) and then carrying out development processing under the same conditions as before and measuring the fog density.

The illumination time required to increase the fog density by 0.02 was taken as the limiting time for illumination with a safe-light.

The results obtained are .shown in Table 2 and Table 3.

TABLE 2

| | Sample No. | Relative Speed | γ Value | Blank Text Image Quality | pH Dependence (Δ log E) |
|---|---|---|---|---|---|
| Comparative Examples | 1 | 100 | 8.7 | 2 | 0.24 |
| Comparative Examples | 2 | 90 | 8.5 | " | 0.28 |
| Comparative Examples | 3 | 102 | 8.8 | " | 0.20 |
| Comparative Examples | 4 | 95 | 8.5 | " | 0.23 |
| Comparative Examples | 5 | 103 | 6.4 | 1 | 0.25 |
| Comparative Examples | 6 | 93 | 6.0 | " | 0.29 |
| Comparative Examples | 7 | 100 | 8.6 | 2 | 0.27 |

TABLE 2-continued

| | Sample No. | Relative Speed | γ Value | Blank Text Image Quality | pH Dependence (Δ log E) |
|---|---|---|---|---|---|
| Comparative Examples | 8 | 91 | " | " | 0.25 |
| Comparative Examples | 9 | 101 | 6.1 | 1 | 0.27 |
| This invention | 10 | 192 | 15.0 | 5 | 0.06 |
| This invention | 11 | 190 | " | " | 0.05 |
| This invention | 12 | 193 | 16.2 | " | 0.05 |
| This invention | 13 | 192 | 16.1 | " | 0.06 |
| This invention | 14 | 177 | 13.3 | 3 | 0.08 |
| This invention | 15 | 170 | 12.1 | 3 | 0.09 |
| This invention | 16 | 190 | 15.0 | 5 | 0.06 |
| This invention | 17 | 172 | 12.0 | 3 | 0.09 |
| This invention | 18 | 191 | 14.8 | 5 | 0.06 |
| This invention | 19 | 170 | 12.8 | 3 | 0.08 |
| This invention | 20 | 161 | 11.7 | 3 | 0.09 |
| This invention | 21 | 187 | 11.5 | 4 | 0.12 |
| This invention | 22 | 185 | 15.0 | 5 | 0.06 |
| This invention | 23 | 188 | 14.6 | " | 0.07 |
| This invention | 24 | 184 | 16.3 | " | 0.05 |

TABLE 3

| | Sample No. | Safe-light Safety |
|---|---|---|
| This Invention | 10 | 30 minutes |
| " | 11 | 42 |
| " | 12 | 35 |
| " | 13 | 47 |
| " | 14 | 8 |
| " | 15 | 13 |
| " | 16 | 45 |
| " | 17 | 12 |
| " | 18 | 48 |
| " | 19 | 12 |
| " | 20 | 18 |
| " | 21 | 28 |
| " | 22 | 45 |
| " | 23 | 43 |
| " | 24 | 55 |

It is clear from the results shown in Table 2 that the samples of this invention had a high photographic speed and gave images which had a high gamma value, that the blank text image quality was also good, and that the pH dependence was also slight.

When the solid dispersed dyes were used, the blank text image quality and the safe-light safety were especially good when a comparison is made with Sample Nos. 14, 15, 17, 19 and 20 in which water soluble dyes had been used.

EXAMPLE 2

Preparation of Emulsion B

An aqueous solution of silver nitrate and an aqueous solution of sodium chloride (containing $5\times10^{-4}$ mol, per mol of silver, of $K_2Ru(NO)Cl_5$) were added using the double jet method to, and mixed in, an aqueous gelatin solution of pH 3.0 which was maintained at 40° C., and a silver chloride emulsion comprised of monodisperse cubic grains of an average grain size 0.08 μm was obtained. After grain formation, $2\times10^{-3}$ mol of 4-hydroxy-6-methyl-1,3,3a,7-tetra-azaindene was added per mol of silver, and the soluble salts were removed by water washing in the usual way. After washing, gelatin was added, sodium chloride and sodium hydroxide were added to adjust to pH=6.0 and pAg=7.6, and $4\times10^{-4}$ mol per mol of silver of 1-phenyl-5-mercaptotetrazole and $5\times10^{-3}$ mol per mol of silver of 4-hydroxy-6-methyl-1,3,3a,7-tetra-azaindene were added as stabilizer. This emulsion contained 110 grams of silver and 38 grams of gelatin per kilogram.

Preparation of Photosensitive Layer Coating Liquid

Emulsion B was divided into equal parts, the hydrazine derivatives of this invention and comparative hydrazine derivatives were added as indicated in Table 4, and 10 mg/m² of the following compound was added as a nucleation accelerator.

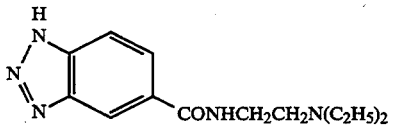

Moreover, the latex disclosed in Example of Manufacture 3 of U.S. Pat. No. 3,525,620 was added in an amount of 900 mg per square meter as a polymer latex, and 1,3-divinylsulfonyl-2-propanol was added in an amount of 100 mg per square meter as a film hardening agent to prepare coating liquids for silver halide emulsion layer purposes.

Preparation of Protective Layer Coating Liquid

The same nucleating agent as that added to the photosensitive layer was added in an amount of 20 mg/m² to an aqueous gelatin solution, poly(ethyl acrylate) latex was added so that the weight of the solid fraction was 500 mg/m², and dyes which had been dispersed in a solid form of this invention and water soluble dyes were added as indicated in Table 4.

Preparation of Over-coat Liquid

Poly(methyl acrylate) of an average particle size about 5 μm was added in an amount of 20 mg/m² to a gelatin solution, amorphous silica matting agent of an average particle size about 3.0 μm was added in an amount of 40 mg/m², polyacrylamide was added in an amount of 100 mg/m², sodium p-dodecylbenzenesulfonate was added in an amount of 40 mg/m² and $C_8F_{17}SO_3N(C_3H_7)CH_2COOK$ was added as a fluorine based surfactant in an amount of 10 mg/m² to prepare a coating liquid for protective layer purposes.

Sample Coating

The aforementioned coating liquid for silver halide emulsion layer purposes which contained a hydrazine derivative was coated as to provide a coated silver weight of 3.4 g/m² on a 100 μm poly(ethylene terephthalate) film support, a protective layer was coated over this to provide 0.8 g/m² of gelatin, and then the over-coat layer was coated over this to provide 0.7 g/m² of gelatin.

TABLE 4

| | | Hydrazine derivative | | Dye | |
|---|---|---|---|---|---|
| | Sample No. | Compound No. | Amount Added (mol/mol · Ag) | Compound No. | Amount added (mg/m²) |
| Comparative Examples | 1 | Compound B | $3.7\times10^{-3}$ | XII-1 | 160 |
| Comparative Examples | 2 | " | " | XII-2 | 160 |
| Comparative Examples | 3 | " | " | VII-9 | 160 |
| This Invention | 4 | I-1 | $3.7\times10^{-3}$ | VII-9 | 160 |
| This Invention | 5 | I-4 | " | " | " |
| This Invention | 6 | I-14 | " | " | " |
| This Invention | 7 | I-19 | " | " | " |
| This Invention | 8 | I-1 | " | XII-1 | " |
| This Invention | 9 | " | " | XII-2 | " |
| This Invention | 10 | " | " | VII-1 | 80 |
| This Invention | 11 | " | " | V-1 | 160 |
| This Invention | 12 | " | " | VII-1 | 80 |
| This Invention | | " | " | VII-9 | 160 |

Compound B

TABLE 4-continued

| | Sample No. | Hydrazine derivative Compound No. | Hydrazine derivative Amount Added (mol/mol · Ag) | Dye Compound No. | Dye Amount added ($mg/m^2$) |
|---|---|---|---|---|---|

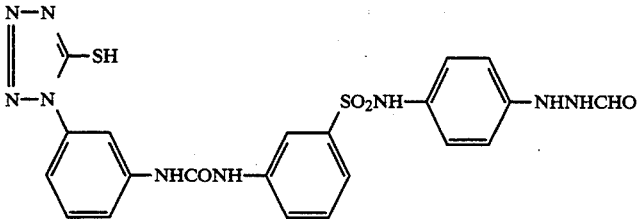

Dye VIII-1

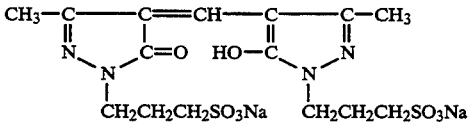

Dye VIII-2

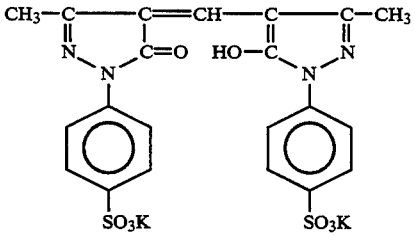

Evaluation of Photographic Properties

Photographic performance was evaluated in the same way as in Example 1 using each of the samples which had been prepared. The results obtained are shown in Table 5 and Table 6. From these results it is clear that the samples of this invention have a high photographic speed and gave images which have a high gamma value, that the blank text image quality is also excellent, and that the resistance to developer pH fluctuation is also good.

TABLE 5

| | Sample No. | Relative Speed | γ Value | Blank Text Image Quality | pH Dependence (Δ log E) |
|---|---|---|---|---|---|
| Comparative Examples | 1 | 100 | 6.9 | 2 | 0.26 |
| Comparative Examples | 2 | 80 | 6.7 | 2 | 0.25 |
| Comparative Examples | 3 | 102 | 7.5 | 3 | 0.20 |
| This Invention | 4 | 156 | 11.6 | 5 | 0.09 |
| This Invention | 5 | 133 | 11.2 | 5 | 0.11 |
| This Invention | 6 | 175 | 12.2 | 5 | 0.07 |
| This Invention | 7 | 160 | 12.0 | 5 | 0.10 |
| This Invention | 8 | 158 | 9.4 | 4 | 0.13 |
| This Invention | 9 | 154 | 9.7 | 4 | 0.14 |
| This Invention | 10 | 142 | 11.5 | 5 | 0.06 |
| This Invention | 11 | 155 | 12.0 | 5 | 0.08 |

TABLE 5-continued

| | Sample No. | Relative Speed | γ Value | Blank Text Image Quality | pH Dependence (Δ log E) |
|---|---|---|---|---|---|
| This Invention | 12 | 140 | 11.3 | 5 | 0.08 |

TABLE 6

| | Sample No. | Safe-light Safety |
|---|---|---|
| This Invention | 4 | 60 minutes |
| " | 5 | 75 |
| " | 6 | 50 |
| " | 7 | 55 |
| " | 8 | 12 |
| " | 9 | 15 |
| " | 10 | 40 |
| " | 11 | 50 |
| " | 12 | 80 |

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a support, having thereon at least one photosensitive layer which contains a non-chemically sensitized silver halide emulsion containing at least 80 mol % silver chloride based on the total amount of silver halide in the emulsion, wherein a hydrazine derivative represented by General Formula (IV) below is included in said photosensitive layer or in another hydrophilic colloid layer, and which material has been image-wise exposed and then developed in a developer which has a pH of at least 9.0 but not more than 11.0 and which contains at least 0.15 mol/liter of sulfite:

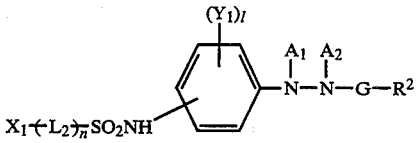

(IV)

wherein $A_1$ and $A_2$ both represent hydrogen atoms, or one represents a hydrogen atom and the other represents a sulfinic acid group or an acyl group; G represents a —CO—, —$SO_2$—, —SO—, —COCO—, thiocarbonyl, iminomethylene or —P(O)($R^4$)— group; $R^2$ represents an alkyl group, aryl group, amino group, alkoxy group or aryloxy group, and $R^2$ may be a group which promotes adsorption of the hydrazine derivative onto silver halide; $R^4$ represents a hydrogen atom, an aliphatic group, an aromatic group, an alkoxy group, an aryloxy group or an amino group; $X_l$ represents a group which promotes adsorption of the hydrazine derivative onto a silver halide; $L_2$ represents a divalent linking group; $Y_1$ represents an alkyl group, an aralkyl group, an alkenyl group, an alkynyl group, an alkoxy group, an aryl group, an amino group, an aryloxy group, a sulfamoyl group, a carbamoyl group, an alkylthio group, an arylthio group, a sulfonyl group, a sulfinyl group, a hydroxy group, a halogen atom, a cyano group, a sulfo group, a carboxyl group, an alkyl oxycarbonyl group, an aryl oxycarbonyl group, an acyl group, an alkoxycarbonyl group, an acyloxy group, a carboxamido group, a sulfonamido group, a nitro group, or a group represented by the following General Formula (c); n is 0 or 1; and l is 0, 1 or 2, provided that when l is 2 the $Y_1$ groups may be the same or different:

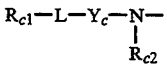

General Formula (c)

wherein $Y_c$ represents —CO—, —$SO_2$—, —P(O)($R_{c3}$)— or —OP(O)($R_{c3}$)— (where $R_{c3}$ represents an alkoxy group having 1 to 12 carbon atoms or an aryloxy group having 6 to 12 carbon atoms), and L represents a single bond, —O—, —S— or —$NR_{c4}$— (where $R_{c4}$ represents a hydrogen atom, an alkyl group having 1 to 12 carbon atoms or an aryl group having 6 to 12 carbon atoms); $R_{c1}$ and $R_{c2}$ individually represent a hydrogen atom, an aliphatic group having 3 to 28 carbon atoms, an aromatic group having 6 to 50 carbon atoms or a heterocyclic group having 6 to 50 carbon atoms, where $R_{c1}$ and $R_{c2}$ may be the same or different or may be joined together to form a ring.

2. The photographic material of claim 1, wherein the developer has a pH of 9.6 to 11.0.

3. The photographic material of claim 1, wherein the developer has a pH of 10.0 to 11.0.

4. The photographic material of claim 1, wherein G is —CO— or —COCO—.

5. The photographic material of claim 1, wherein $X_1$ represents a thioamido group a mercapto group, a disulfide group, or a nitrogen containing heterocyclic group.

6. The photographic material of claim 1, wherein $R^2$ represents an alkyl group or aryl group.

7. The photographic material of claim 6, wherein $R^2$ represents an alkyl group.

8. The photographic material of claim 6, wherein $R^2$ contains a substituent which is an electron withdrawing group.

9. The photographic material of claim 7, wherein $R^2$ contains a substituent which is an electron withdrawing group.

10. The silver halide photographic material according to claim 1, wherein the $X_1$—$(L_2)_n$—$SO_2NH$— group is substituted in a position para to the hydrazino group.

11. The photographic material of claim 6, wherein the substituent on the aryl group is selected from the group consisting of —CN, a Cl atom, —OH, —$CH_2OH$, and —$COOC_2H_5$.

12. The photographic material of claim 7, wherein the substituted alkyl group is selected from the group consisting of —$CF_3$, —$CH_2CN$, —$CH_2OCH_3$, —$CH_2SO_2CF_3$, —$NHCH_3$, and —$OC_2H_5$.

13. A method for processing an image-wise exposed silver halide photographic material, comprising the step of, subjecting the photographic material to developing in a developer which has a pH of at least 9.0 but no more than 11.0 and which contains at least 0.15 mol/liter of sulfite, wherein the photographic material comprises a support having thereon at least one photosensitive layer which comprises a non-chemically sensitized silver halide emulsion containing at least 80 mol % silver chloride based upon the total amount of silver halide in the emulsion, and wherein the at least one photosensitive layer or another hydrophilic colloid layer comprises a hydrazine derivative represented by the following General Formula (IV):

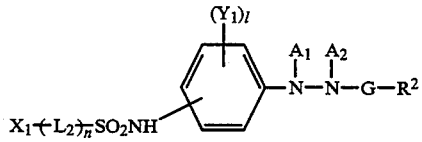

(IV)

wherein $A_1$ and $A_2$ both represent hydrogen atoms, or one represents a hydrogen atom and the other represents a sulfinic acid group or an acyl group; G represents a —CO—, —$SO_2$—, —SO—, —COCO—, thiocarbonyl, iminomethylene or —P(O)($R^4$)— group; $R^2$ represents an alkyl group, aryl group, amino group, alkoxy group or aryloxy group, and $R^2$ may be a group which promotes adsorption of the hydrazine derivative onto silver halide; $R^4$ represents a hydrogen atom, an aliphatic group, an aromatic group, an alkoxy group, an aryloxy group or an amino group; $X_1$ represents a group which promotes adsorption of the hydrazine derivative onto a silver halide; $L_2$ represents a divalent linking group; $Y_1$ represents an alkyl group, an aralkyl group, an alkenyl group, an alkynyl group, an alkoxy group, an aryl group, an amino group, an aryloxy group, a sulfamoyl group, a carbamoyl group, an alkylthio group, an arylthio group, a sulfonyl group, a sulfinyl group, a hydroxy group, a halogen atom, a cyano group, a sulfo group, a carboxyl group, an alkyl oxycarbonyl group, an aryl oxycarbonyl group, an acyl group, an alkoxycarbonyl group, an acyloxy group, a carboxamido group, a sulfonamido group, a nitro group, or a group represented by the following General Formula (c); n is 0 or 1; and l is 0, 1 or 2, provided that when l is 2 the $Y_1$ groups may be the same or different:

$$R_{c1}-L-Y_c-\underset{\underset{R_{c2}}{|}}{N}-$$ General Formula (c)

wherein $Y_c$ represents —CO—, —$SO_2$—, —P(O)($R_{c3}$)— or —OP(O)($R_{c3}$)— (where $R_{c3}$ represents an alkoxy group having 1 to 12 carbon atoms or an aryloxy group having 6 to 12 carbon atoms); and L represents a single bond, —O—, —S— or —$NR_{c4}$—, (where $R_{c4}$ represents a hydrogen atom, an alkyl group having 1 to 12 carbon atoms or an aryl group having 6 to 12 carbon atoms); $R_{c1}$ and $R_{c2}$ individually represent a hydrogen atom, an aliphatic group having 3 to 28 carbon atoms, an aromatic group having 6 to 50 carbon atoms or a heterocyclic group having 6 to 50 carbon atoms, where $R_{c1}$ and $R_{c2}$ may be the same or different or may be joined together to form a ring.

14. The method for processing a photographic material of claim 13, wherein the developer has a pH of 9.6 to 11.0.

15. The method for processing a photographic material of claim 13, wherein the developer has a pH of 10.0 to 11.0.

16. The method for processing a photographic material of claim 13, wherein G is —CO— or —COCO—.

17. The method for processing a photographic material of claim 13, wherein $X_1$ represents a cyclic thioamido group, a mercapto group, a disulfide group or a nitrogen containing heterocyclic group.

18. The method for processing a photographic material of claim 13, wherein $R^2$ represents a alkyl group or aryl group.

19. The method for processing a photographic material of claim 18, wherein $R^2$ represents an alkyl group.

20. The method for processing a photographic material of claim 18, wherein $R^2$ contains a substituent which is an electron withdrawing group.

21. The method for processing a photographic material of claim 19, wherein $R^2$ contains a substituent which is an electron withdrawing group.

22. The method for processing silver halide photographic material according to claim 13, wherein the $X_1$—$(L_2)_n$—$SO_2NH$— group is substituted in a position para to the hydrazine group.

23. The method for processing photographic material of claim 18, wherein the substituent on the aryl group is selected from the group consisting of —CN, a Cl atom, —OH, —$CH_2OH$, and —$COOC_2H_5$.

24. The method for processing photographic material of claim 19, wherein the substituted alkyl group is selected from the group consisting of —$CF_3$, —$CH_2CN$, —$CH_2OCH_3$, —$CH_2SO_2CF_3$, —$NHCH_3$, and —$OC_2H_5$.

* * * * *